US005371431A

United States Patent [19]

Jones et al.

[11] Patent Number: 5,371,431

[45] Date of Patent: Dec. 6, 1994

[54] VERTICAL MICROELECTRONIC FIELD EMISSION DEVICES INCLUDING ELONGATE VERTICAL PILLARS HAVING RESISTIVE BOTTOM PORTIONS

[75] Inventors: Gary W. Jones; Ching-Tzong Sune, both of Raleigh, N.C.

[73] Assignee: MCNC, Research Triangle Park, N.C.

[21] Appl. No.: 846,281

[22] Filed: Mar. 4, 1992

[51] Int. Cl.[5] ..... H01J 1/30

[52] U.S. Cl. ..... 313/309; 313/312; 313/351; 313/336; 313/497; 345/47

[58] Field of Search ..... 313/309, 311, 312, 336, 313/351, 495, 496, 497; 315/169.4; 345/37, 41, 47, 60

[56] References Cited

U.S. PATENT DOCUMENTS

| | | | |
|---|---|---|---|
| 3,665,241 | 5/1972 | Spindt et al. | 313/351 |
| 3,921,022 | 11/1975 | Levine | 313/336 X |
| 3,970,887 | 7/1976 | Smith et al. | 313/309 |
| 3,998,678 | 12/1976 | Fukase et al. | 313/336 X |
| 4,008,412 | 2/1977 | Yuito et al. | 313/336 X |
| 4,095,133 | 6/1978 | Hoeberechts | 313/336 |
| 4,163,949 | 8/1979 | Shelton | 313/351 X |
| 4,307,507 | 12/1981 | Gray et al. | 313/309 X |
| 4,513,308 | 4/1985 | Greene et al. | 313/309 X |
| 4,578,614 | 3/1986 | Gray et al. | 313/309 |
| 4,818,914 | 4/1991 | Brodie | 313/336 X |
| 4,964,946 | 10/1990 | Gray et al. | 313/309 X |
| 4,990,766 | 2/1991 | Simms et al. | 313/336 X |
| 5,012,153 | 4/1991 | Atkinson et al. | 313/351 X |
| 5,030,895 | 7/1991 | Gray | 313/336 X |
| 5,053,673 | 10/1991 | Tomii et al. | 313/309 X |
| 5,142,184 | 8/1992 | Kane | 313/309 |
| 5,164,632 | 11/1992 | Yoshida et al. | 313/336 X |

OTHER PUBLICATIONS

*Control of Silicon Field Emitter Shape With Isotropically Etched Oxide Masks*, J. B. Warren, Inst. Phys. Conf. Ser. No. 99; Section 2; Paper Presented at 2nd Int. Conf. on Vac. Microelectron., Bath, 1989, pp. 37–40.

*Primary Examiner*—Donald J. Yusko
*Assistant Examiner*—Ashok Patel
*Attorney, Agent, or Firm*—Bell, Seltzer, Park & Gibson

[57] ABSTRACT

A vertical microelectronic field emitter includes a conductive top portion and a resistive bottom portion in an elongated column which extends vertically from a horizontal substrate. An emitter electrode may be formed at the base of the column, and an extraction electrode may be formed adjacent the top of the column. The elongated column reduces the parasitic capacitance of the microelectronic field emitter to provide high speed operation, while providing uniform column-to-column resistance. The field emitter may be formed by first forming tips on the face of a substrate and then forming trenches in the substrate around the tips to form columns in the substrate, with the tips lying on top of the columns. The trenches are filled with a dielectric and a conductor layer is formed on the dielectric. Alternatively, trenches may be formed in the face of the substrate with the trenches defining columns in the substrate. Then, tips are formed on top of the columns. The trenches are filled with dielectric and the conductor layer is formed on the dielectric to form the extraction electrodes.

24 Claims, 33 Drawing Sheets

VERTICAL MICROELECTRONIC FIELD EMISSION DEVICES INCLUDING ELONGATE VERTICAL PILLARS HAVING RESISTIVE BOTTOM PORTIONS

FIELD OF THE INVENTION

This invention relates to semiconductor devices and fabrication methods and more particularly to microelectronic field emission devices and methods of fabricating the same.

BACKGROUND OF THE INVENTION

Microminiature emitters are well known in the microelectronics art, and are often referred to as "field emitters". These microminiature field emitters are finding widespread use as electron sources in microelectronic devices. For example, field emitters may be used as electron guns. When the electrons are directed to a photoluminescent material they may be used for high density display devices. Moreover, the field emitter may be coupled to appropriate microelectronic control electrodes to produce a microelectronic analog to a vacuum tube and thereby produce vacuum integrated circuits.

A field emitter typically includes a microelectronic emission surface, also referred to as a "tip", to enhance electron emissions. Conical, pyramidal and linear pointed tips are often used. Alternatively a flat tip of low work function material may be provided. An emitter electrode typically electrically contacts the tip. An extraction electrode is typically provided adjacent but not touching the field emission tip, to form an electron emission gap therebetween. Upon application of an appropriate voltage between the emitter electrode and the extraction electrode, quantum mechanical tunneling or other known phenomena cause the tip to emit an electron beam. In microelectronic applications, an array of field emission tips may be formed on the horizontal face of a substrate such as a silicon semiconductor substrate. Emitter electrodes, extraction electrodes and other electrodes as necessary may also be provided on or in the substrate. Support circuitry may also be fabricated on or in the substrate, using well known microelectronic techniques.

Field emitters may be classified as either "vertical" field emitters or "horizontal" field emitters, depending upon the orientation of the emitted electron beam relative to the horizontal substrate face. Horizontal emitters emit a beam of electrons generally parallel to the horizontal face of the substrate on which they are formed. Typically, these emitters are formed by fabricating discrete horizontal emitters and horizontal electrodes in a single horizontal layer parallel to the horizontal face of the semiconductor substrate. In other words, horizontal emitters, horizontal extraction electrodes and horizontal collector or other electrodes are formed. See for example U.S. Pat. Nos. 4,728,851 to Lambe and 4,827,177 to Lee et al.

Unfortunately, horizontal field emitters have been difficult to manufacture and have been limited in power handling capacity and speed. In particular, the manufacture of a horizontal field emitter has required the formation of discrete horizontal microelectronic structures in a single horizontal layer on a substrate. It has been difficult to fabricate these small, discrete horizontal structures with a small spacing therebetween. Moreover, the emitter and electrode layers have typically been formed of closely spaced metallization layers, thereby limiting device speed. A horizontal field emitter structure and fabrication method which overcome these problems is described in copending application Ser. No. 07,714,275 filed by the present inventors on Jun. 12, 1991 now U.S. Pat. No. 5,144,191 issued Sep. 1, 1992, and assigned to the assignee of the present invention, the disclosure of which is hereby incorporated herein by reference.

The second class of emitters is generally referred to as "vertical" emitters. In a vertical field emitter, one or more emitter tips are formed on the horizontal face of a substrate to emit electrons vertically, i.e. perpendicular to the face of the substrate. A plurality of horizontal electrode layers may be formed on or in, and generally parallel to, the substrate face, to provide extraction electrodes and other control electrodes as necessary. Such vertical field emitters are described in U.S. Pat. Nos. 3,921,022 to Levine; 3,970,887 to Smith et al.; 3,998,678 to Fukase et al.; 4,008,412 to Yuito et al.; 4,095,133 to Hoeberechts; 4,163,949 to Shelton; 4,307,507 to Gray et al.; 4,513,308 to Greene et al.; 4,578,614 to Gray et al.; 4,663,559 to Christensen; 4,721,885 to Brodie; 4,835,438 to Baptist et al.; 4,940,916 to Borel et al.; 4,964,946 to Gray et al.; 4,990,766 to Simms et al.: and 5,030,895 to Gray.

Unfortunately, vertical field emitters have also been difficult to manufacture and have been limited in power handling capacity and speed. In particular, it has heretofore been difficult to form the vertical emitter tips and the plurality of horizontal electrode layers on the semiconductor substrate adjacent but not touching one another. Moreover, vertical field emitters are limited in their power handling capacity. Finally, because the electrode layers are separated from one another by thin insulating layers, the resulting device capacitance is high, thereby limiting device speed.

A publication by Warren, entitled *Control of Silicon Field Emitter Shape with Isotropically Etched Oxide Masks*, Vacuum Microelectronics 89, pp. 37–40, 1989, describes techniques for controlling field emitter diameter and tip radius in silicon by carefully controlling the shape of the oxide mask used to protect the emitter column during reactive ion etching. Controlled attack of the concave oxide mask during reactive ion etching forms a silicon emitter column with tapered sides and a tip with a sub-micron radius of curvature. There is no suggestion to form a vertical microelectronic field emission device, nor is there any suggestion as to how such a device could be formed.

U.S. Pat. No. 5,053,673 to Tomii et al. discloses a method of making a vertical field emitter in which pairs of substrates, each having a patterned thin layer of cathode material therebetween, are sliced into a plurality of sections, to obtain substrates, each having an array of exposed regions of cathode material. Unfortunately, it may be difficult to repeatedly and accurately bond and slice multiple substrates for mass production.

SUMMARY OF THE INVENTION

It is therefore an object of the invention to provide high performance microelectronic field emitters and methods of making the same.

It is yet another object of the present invention to provide high performance vertical microelectronic field emitters, and methods of making the same.

It is still another object of the present invention to provide high performance vertical microelectronic field emitters, which are particularly suitable for display applications, and methods of making the same.

These and other objects are provided according to the present invention by forming an array of elongated columns on a substrate, with each column having a vertical wall extending from the substrate, and a top opposite the substrate. An electron emission surface, also referred to as a "tip" is formed on each top so that the electron emitter tip is separated from the substrate by the elongated column. An emitter electrode is formed at the base of the column. An insulating layer is formed on the substrate, between the columns, and at least one electrode is formed on the insulating layer adjacent the tip for extracting electrons from the tip. The columns and insulating layer reduce the parasitic capacitance of the emitter and prevent charge transfer between the emitters, to thereby produce high speed devices.

The microelectronic field emitter of the present invention may be formed using one of two general methods, the individual steps of which may be implemented using standard microelectronic techniques. In the first method, the tips are first formed on the face of a substrate. Then, trenches are formed in the substrate around the tips to form columns in the substrate, with the tips lying on top of the columns. The trenches may be filled with a dielectric and a conductor layer may be formed on the dielectric. This method may be generally referred to as a "tips first" method.

The other general method for forming microelectronic emitters is a "columns first" method. Trenches are formed in the face of a substrate, with the trenches defining columns in the substrate. Then tips are formed on top of the columns. The trenches may be filled with dielectric and the conductor layer may be formed on the dielectric to form the extraction electrodes.

In either method, the emitters of the present invention include emitter tips on top of elongated columns, to provide low parasitic capacitance and low charge transfer between adjacent devices. Self-aligned techniques may be used to form electrodes which are self-aligned to emitter tips having high aspect ratios. High frequency operation may thereby be provided in a vertical field emitter.

The above described methods may be used to form field emitter structures which are particularly suitable for flat panel display applications. For display applications, it is typically required to have resistors in the field emitter columns in order to limit the current in each emitter. The resistors must all be of the same value so that the current, and therefore the brightness, of each pixel is the same. According to the invention, a resistive layer such as gold doped amorphous silicon, is formed on a substrate, and a conductive layer such as tungsten or titanium-tungsten, is formed on the resistive layer. Trenches are then formed to define the emitter columns having a resistive bottom portion and a conductive top portion. The device may be planarized using polishing or other known techniques. This polishing does not change the value of the resistive portion, since the resistive portion is at the bottom of the column. A tip may be formed in the resistive portion. The tip may be formed of a low work function material. An edge emitting cap may also be formed on the column, to enhance edge emission of electrons for display applications.

The field emitters of the present invention may also be encapsulated to form a functional device. A rim may be formed around groups of emitters to provide a well for a vacuum cavity. A cover is then placed over the emitter array and sealed in a vacuum, inert gas, electroluminescent gas or other atmosphere. Sealing may use reflowable glass, solder or oxide bonding techniques. The cover may include interconnection patterns if desired and may even include active devices. The cover may also be formed by forming a cantilever over one or more emitters and then forming the cover on the cantilever. For display applications, a cover may include an egg-crate pattern to encapsulate groups of pixels and provide separation between the display screen and the emitters.

DESCRIPTION OF A PREFERRED EMBODIMENT

The present invention now will be described more fully hereinafter with reference to the accompanying drawings, in which a preferred embodiment of the invention is shown. This invention may, however, be embodied in many different forms and should not be construed as limited to the embodiment set forth herein; rather, this embodiment is provided so that this disclosure will be thorough and complete, and will fully convey the scope of the invention to those skilled in the art. Like numbers refer to like elements throughout.

Figure 1:
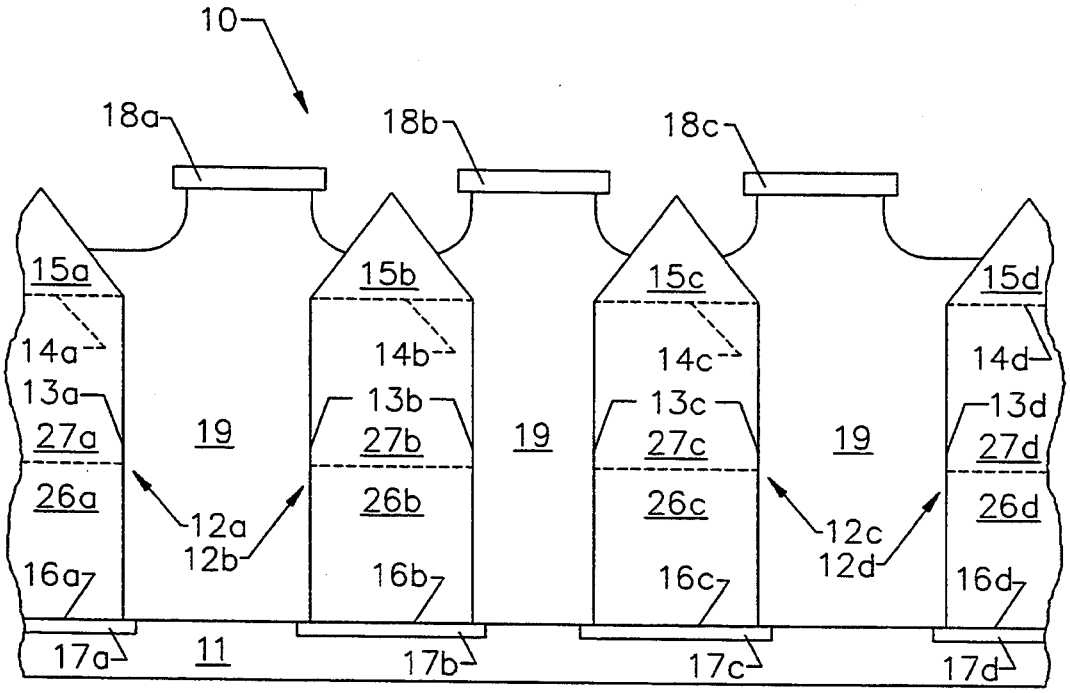
FIG. 1 illustrates a simplified cross-sectional view of a vertical microelectronic field emitter according to the present invention.

Referring now to FIG. 1, a simplified cross-sectional view of a vertical microelectronic field emitter according to the present invention will now be described. As shown in FIG. 1, vertical field emitter 10 is formed on the horizontal face of a substrate 11. Substrate 11 includes an array of elongated vertical columns 12*a*–12*d* extending therefrom, with each column having a base 16*a*–16*d* respectively, a wall 13*a*–13*d* respectively, and a top 14*a*–14*d* respectively, opposite the substrate 11. An electron emitter tip 15*a*–15*d* is formed on a respective one of the tops 14*a*–14*d*. The electron emitter tips 15*a*–15*d* may be conical, pyramidal or elongated tips, and more than one tip 15 may be formed on a column 12. Alternatively, the tips 15*a*–15*d* may be flat caps of a low work function material.

At least one emitter electrode 17*a*–17*d* is formed at the base 16*a*–16*d*. At least one extraction electrode 18*a*–18*c* is formed adjacent the tips 15*a*–15*d* for extracting electrons from the tips upon application of an appropriate voltage between emitter electrodes 17 and extraction electrodes 18. As also shown in FIG. 1, an insulating or dielectric layer 19 is also formed on the substrate extending onto the walls 13. The extraction electrodes 18*a*–18*c* are preferably formed on the insulating layer 19. It will be understood by those having skill in the art that when an element is described herein as being "on" another element, it may be formed directly on the element, or one or more intervening layers may be provided between the elements.

The field emitter 10 of FIG. 1 contrasts from known field emitters because the tips 15 are formed on top of elongated vertical columns 12 rather than on the substrate itself. By forming the emitter tips at the top of elongated columns, parasitic capacitance and charge transfer is reduced, due to the increased separation between emitter electrodes 17 and extraction electrodes 18.

Figure 2A:
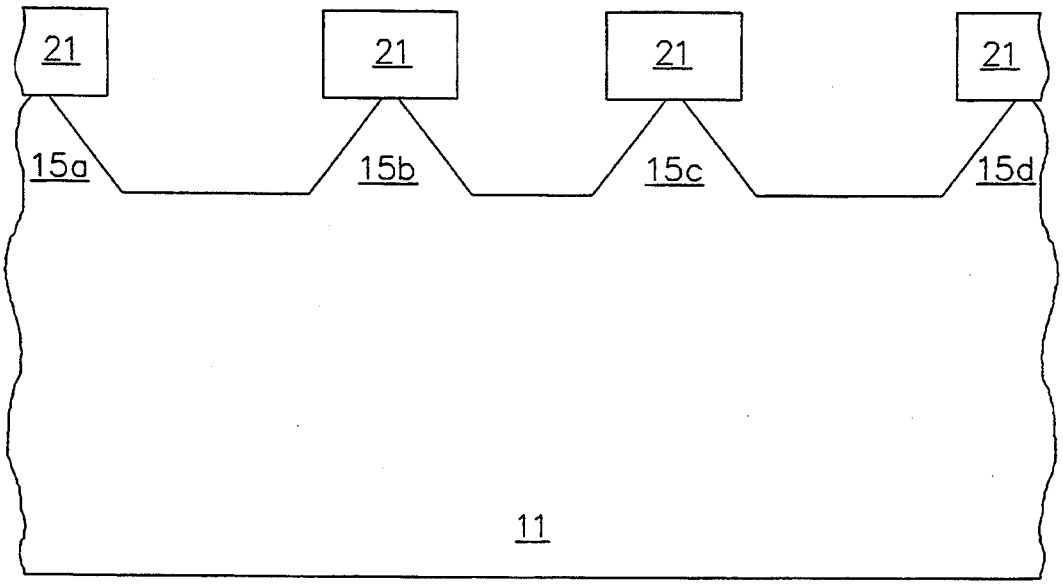
FIGS. 2A–2B illustrates cross-sectional views of a field emitter formed by a simplified "tips first" method, according to the present invention.
Figure 2B:
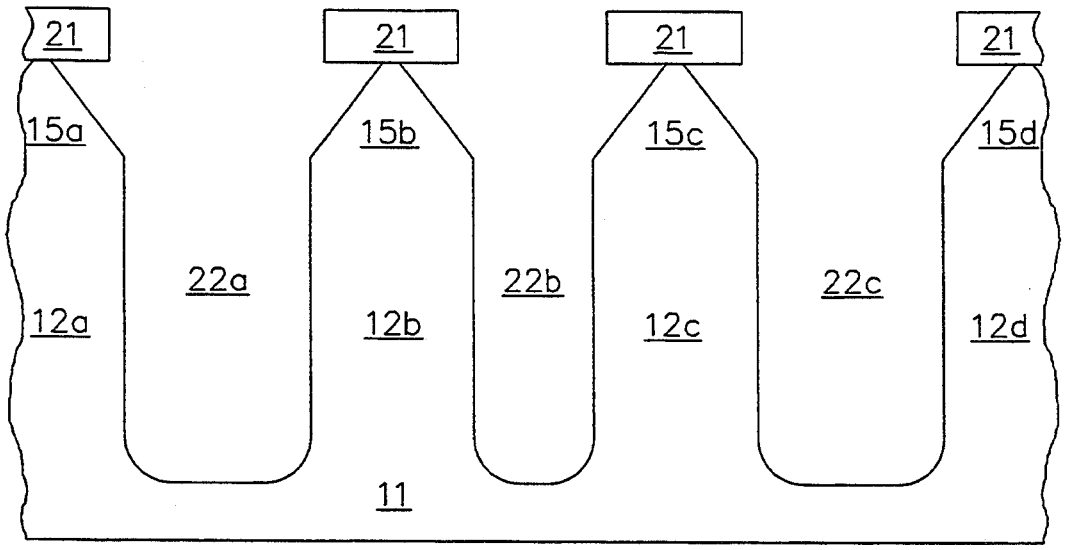

Referring now to FIGS. 2A–2B and 3A–3B, two general methods of the forming vertical field emitter 10 of FIG. 1 are shown. The method of FIGS. 2A–2B may be characterized as a "tips first" method, while the method of FIGS. 3A–3B may be characterized as a "columns first" method. Specifically, as shown in FIG. 2A, emitter tips 15*a*–15*d* are formed in substrate 11, for example by etching through mask 21. Then, as shown in FIG. 2B, trenches 22*a*–22*c* are formed in the substrate around the tips 15*a*–15*d*, to form columns 12*a*–12*d* in the substrate, with the tips lying on top of the columns. The columns may then be filled with a dielectric and electrodes may be formed as needed.

Figure 3A:
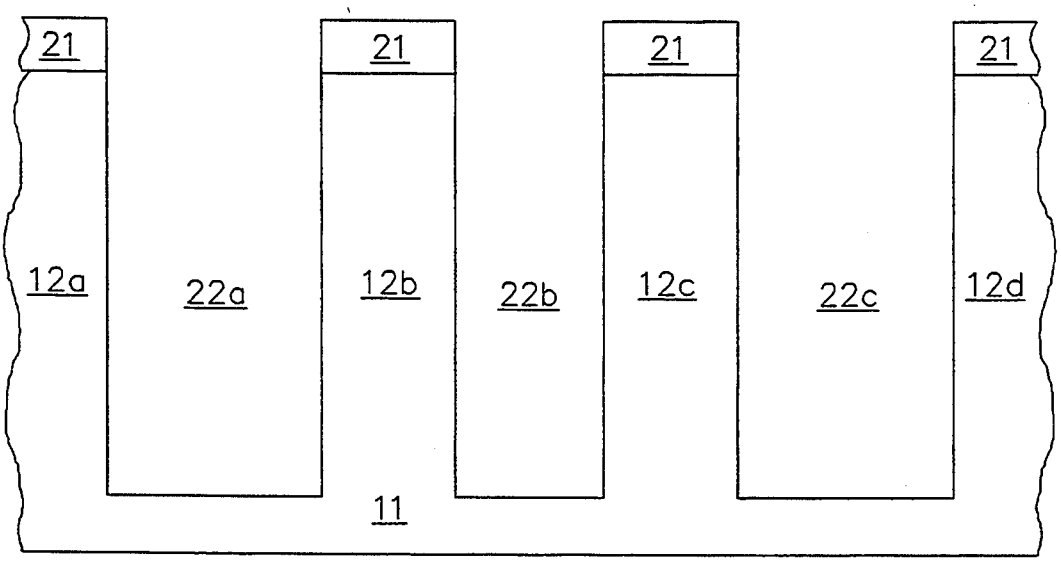
FIGS. 3A–3B illustrate cross-sectional views of a field emitter formed by a simplified "columns first" method, according to the present invention.
Figure 3B:
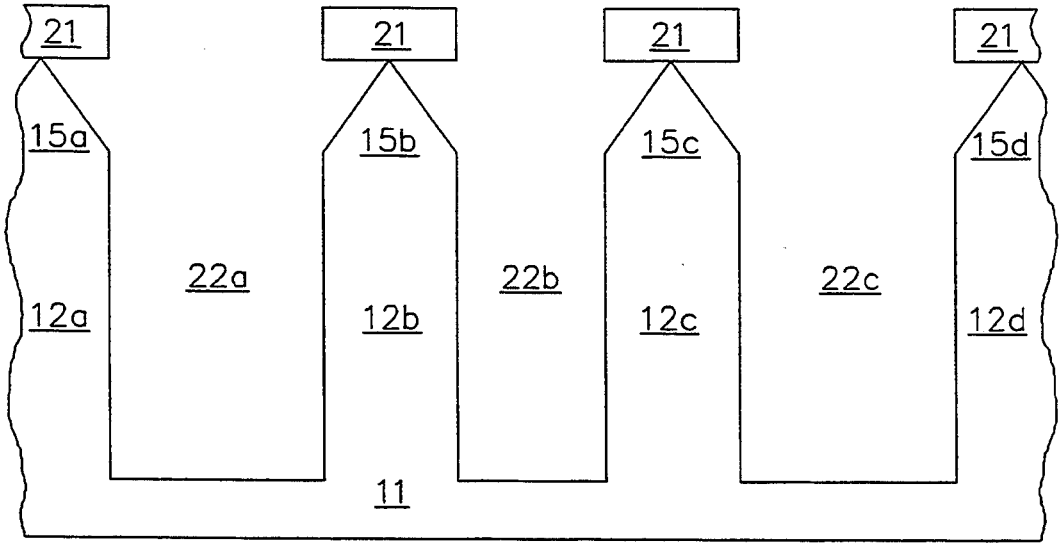

In the "columns first" technique of FIGS. 3A–3B, trenches 22*a*–22*c* are first formed in the face of the substrate 11 by etching through mask 21. Then, tips 15*a*–15*d* are formed at the top of columns 12*a*–12*d*. The trenches 22*a*–22*c* may be filled with a dielectric, either before or after forming tips 15. Alternatively, the trenches may be partially filled before, and the remainder of the trenches may be filled after forming tips 15.

It will be understood by those having skill in the art that the columns 12 of the present invention may be made of metal (for example sputtered tungsten, single crystal metal such as tungsten or a sputtered titanium-tungsten alloy), conductive ceramic, silicon (doped or undoped), other semiconductor materials or other materials. Tips 15 may be sharpened using any reactive process that thins the tip without damaging the rest of the structure, including but not limited to plasma etching, wet chemical etching or oxidation. When using crystallographic oxidation to provide sharpening, both isotropic (cusp) and anisotropic (pyramid) crystal tips may be sharpened as long as a single crystal tip is used. For example, in the case of <100> silicon, low temperature (900° C., dry oxygen) oxidation has provided the best crystallographic selectivity. <110> silicon may also be etched in a crystallographic etch (such as ethylene diamene and water or aqueous KOH).

Single crystals of other materials may also be selectively chemically sharpened by oxidation or a similar crystallographic consumption process. Alternatively, tips 15 may be sharpened electrochemically, for example by placing a bias on a solution or on the gates relative to the tips, and depositing or etching the tips. This process may be used to sharpen molybdenum, tungsten or precious metal tips such as platinum, pallium, iridium or gold.

Crystalline pyramidal tips 15 may also be grown on top of the columns 12 using selective epitaxial techniques. Nonselective processes may also be used if growth from the column 12 forms a crystal and the remaining growth may be selectively removed. For example, silicon growth from silane on <100> silicon columns may be used.

It will also be understood that the tips may be in the form of a cap of a low work function material such as cesium. A self-aligned cap may be formed by etching the column 12 selectively against the previously polished/etched background dielectric 19 such as silicon dioxide. This etching would create a void above each of the columns. The column may then be filled with another dielectric such as silicon nitride which can be planarized. The surface is then polished, etched back or coated with a spin-on material and etched back to leave a plug over the column and the background dielectric reexposed.

Resistors may be built into the base 16 of the columns 12 or into the substrate 11 to limit current to the tips and to reduce arcing related failures. Resistors may also be built into the extraction electrodes 18 by forming a conductive grid of aluminum, thick platinum or other materials, with the extraction electrode material being of a more resistive material such as titanium silicide, silicon or thin platinum. The grid is used to distribute current evenly around the array while the high resistivity material would limit current to the extraction electrode.

The walls 13 of the columns 12 may also be coated with conductors or other materials to achieve desired effects. For example, chemically vapor deposited tungsten may be used to reduce emitter resistance. Phosphosilicate glass may be used to increase the P-dopant concentration at the wall of the column to make the column more difficult to invert. The walls of the columns may also be doped to make more complex devices and modify the devices diode or transistor current-voltage characteristics.

Figure 4A:
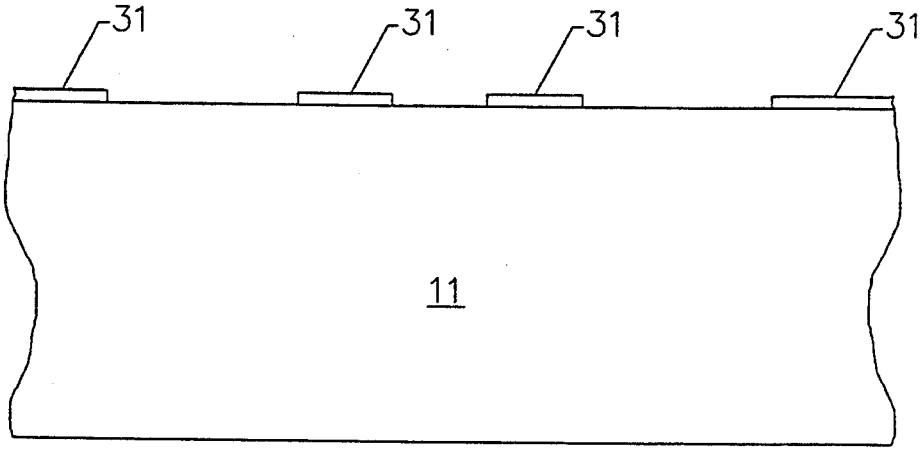
FIGS. 4A–4H illustrate cross-sectional views of a field emitter formed by a first detailed "columns first" method, according to the present invention.
Figure 4B:
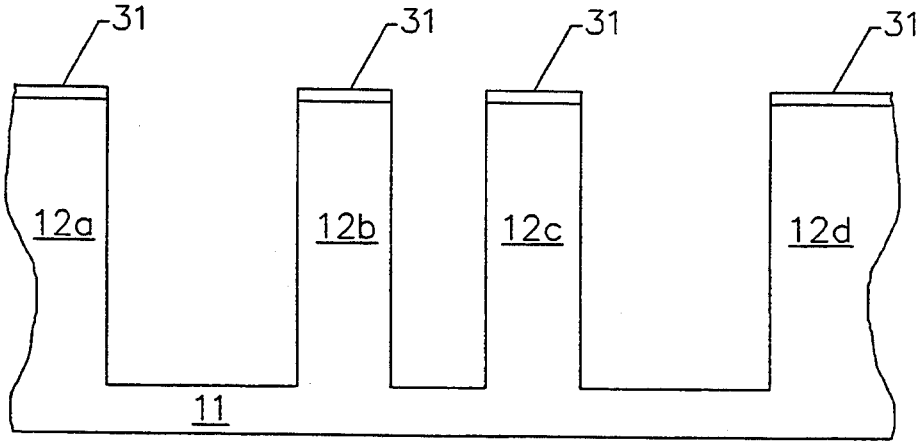
Figure 4C:
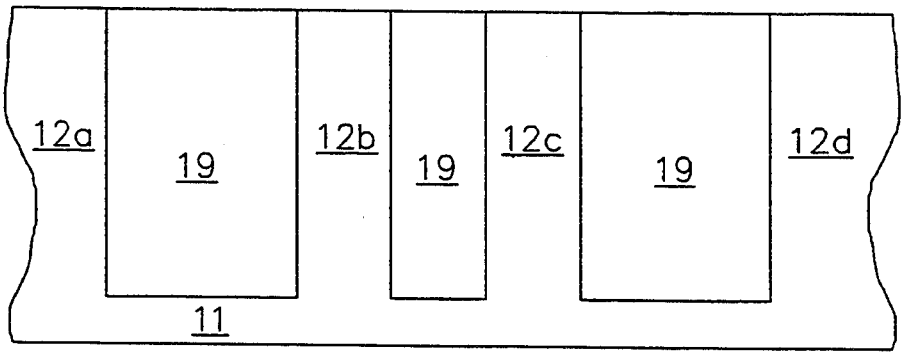

Referring now to FIGS. 4A–4H, a first detailed method for forming a field emitter using a "columns first" technique, according to the present invention, is shown. As shown in FIG. 4A, a patterned oxide layer 31 is formed on a substrate 11 such as a silicon substrate, using conventional oxidation and photolithographic techniques. The silicon substrate is then anisotropically etched, using the oxide layer as a mask, using well known techniques, to form columns 12. See FIG. 4B. As shown in FIG. 4C, the spaces between the columns are then filled with a dielectric 19 such as silicon dioxide, by oxidizing and then planarizing the surface using chemical mechanical polishing.

Figure 4D:
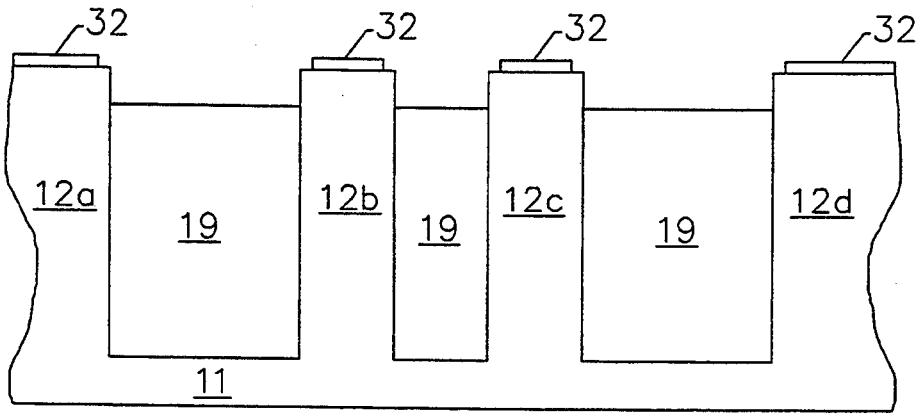
Figure 4E:
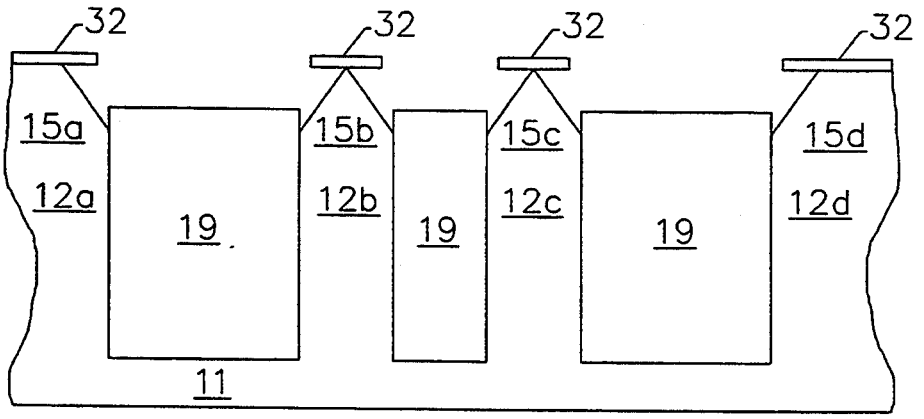

Then, referring to FIG. 4D a second mask layer 32, such as nickel or tungsten may be formed on top of columns 12 using selective deposition techniques. Alternatively, a mask layer 32 of silicon nitride may be formed by etching the top of columns 12 and filling the resultant hole with silicon nitride. Oxide layer 19 is then etched back. Then, referring to FIG. 4E, an anisotropic silicon etch is performed, using mask 32 and oxide 19 as an etch stop to form pointed tips 15*a*–15*d*.

Figure 4F:
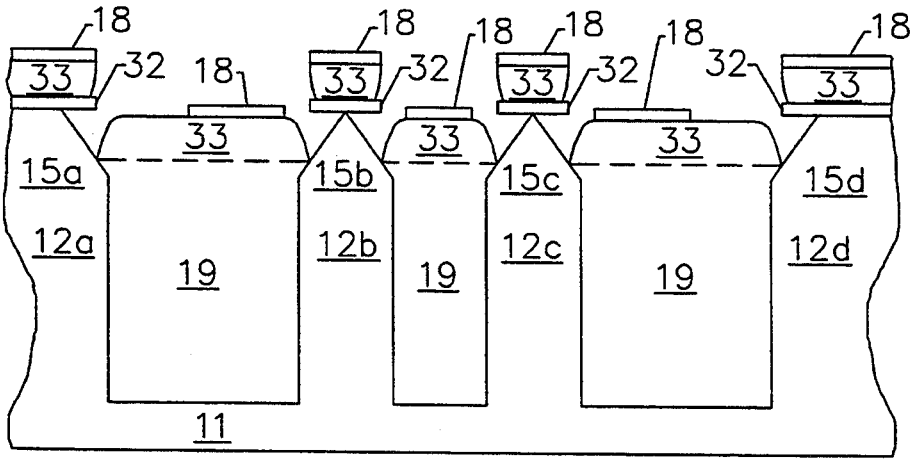

As shown in FIG. 4F, oxide is evaporated onto substrate 11 to cause oxide layer 19 to regrow up to the height of tips 15 and also cause oxide layer 33 to form on mask 32. Then the extractor electrode metal 18 is blanket deposited on substrate 11 to form a layer of metal on oxide 33. It will be understood by those having skill in the art that oxide layer 32 is preferably a material which etches slowly relative to silicon dioxide. This permits removal of oxide from the silicon tip 15 without undercutting the extraction electrode 18 appreciably. Preferably a dielectric is selected which does not etch at a high rate during the tip formation and sharpening process. Accordingly, a wide range of dielectrics may be used. The thick base layer dielectric 19 that separates the columns 12 preferably exhibits low leakage current, good electric field breakdown characteristics and a low dielectric constant. This lower layer provides most of the insulator/dielectric requirements. The second dielectric 33 may have less stringent requirements so that etch rate may be the primary issue of importance, and thereby allow many insulator material options.

Figure 4G:
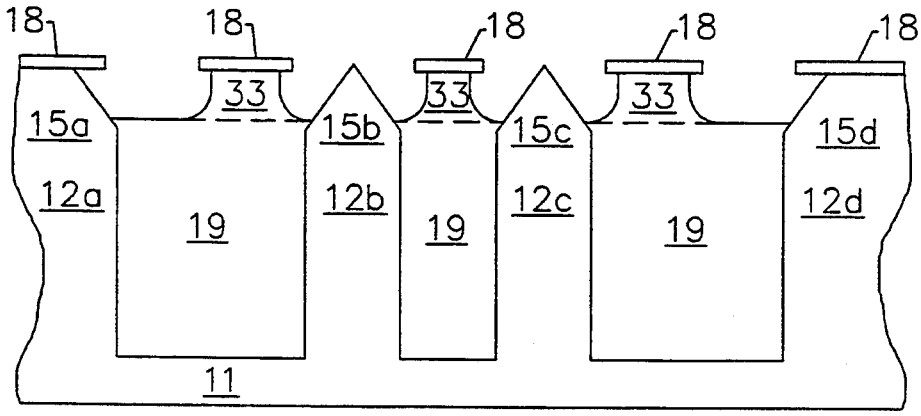

Referring now to FIG. 4G, a lift off technique is then used to remove mask 32, and simultaneously remove layers 33 and 18 from tips 15. The tips may also be resharpened.

It will be understood by those having skill in the art that the overhanging extraction electrode 18 may be used to permit evaporation of materials onto the tip 15 without shorting the tip 15 to the extractor electrode 18 and without the need for a second lithographic step to etch between the extractors. For example, the extraction electrode material may be evaporated on a sacrificial layer. When the sacrificial layer is etched, a gap will form around the extractor.

It will also be understood by those having skill in the art that a recessed emitter assembly may be produced with reduced capacitance and a very small emitter to extractor distance. This may be produced by etching back (wholly or partly or by lifting off) the evaporated cap material and then depositing material again. This process exposes part of the interior wall of the dielectric 19 under the extractor 18 so that the extraction electrode 18 moves down into the recess closer to the emitter.

Figure 4H:
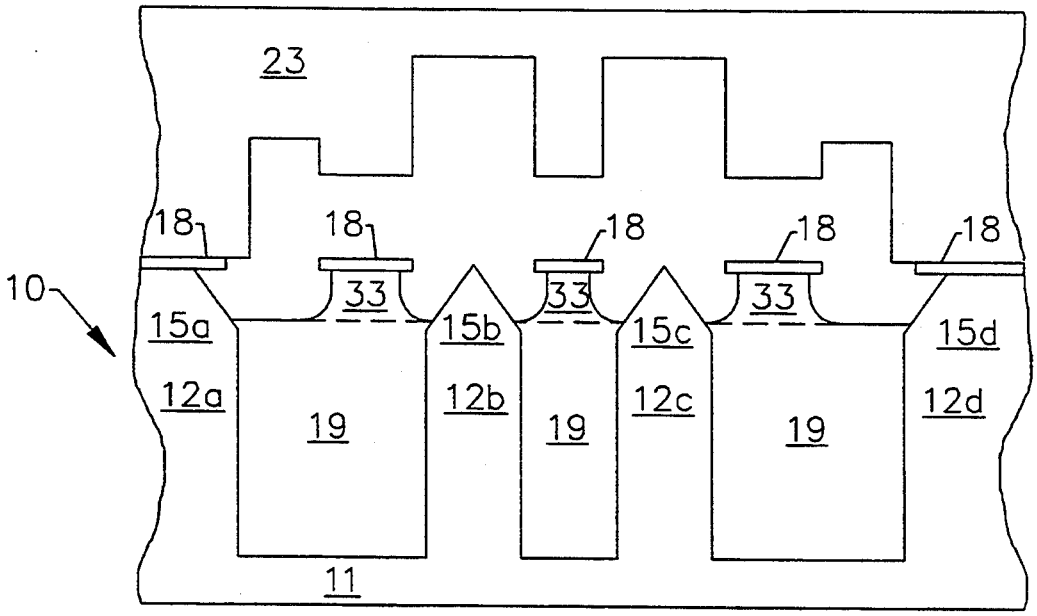

Finally, referring to FIG. 4H, a cover 23 may be mounted on field emitter 10 to encapsulate the field emission tips. The cover may include conductors and other control electrodes therein, depending upon the application. The cover may also include a phosphor or other photoluminescent layer therein to provide a display. Detailed operations for forming the cover and mounting the cover on the field emitter 10 will be described below.

Figure 5A:
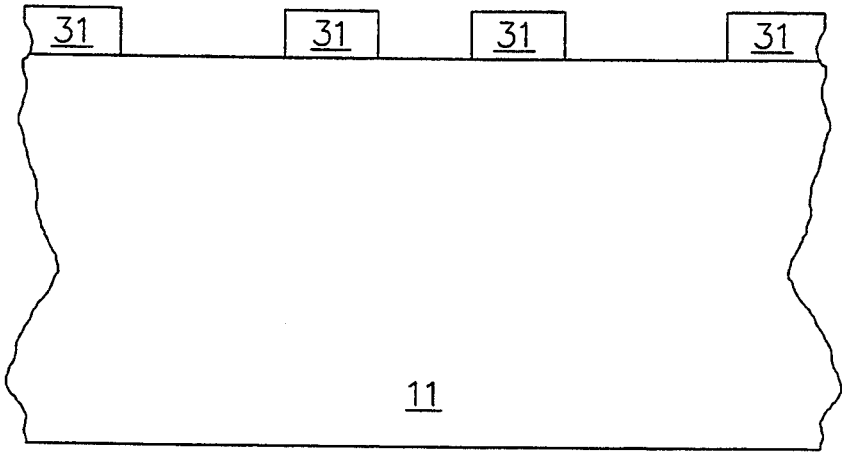
FIGS. 5A–5I illustrate cross-sectional views of a field emitter formed by a first detailed "tips first" method, according to the invention.
Figure 5B:
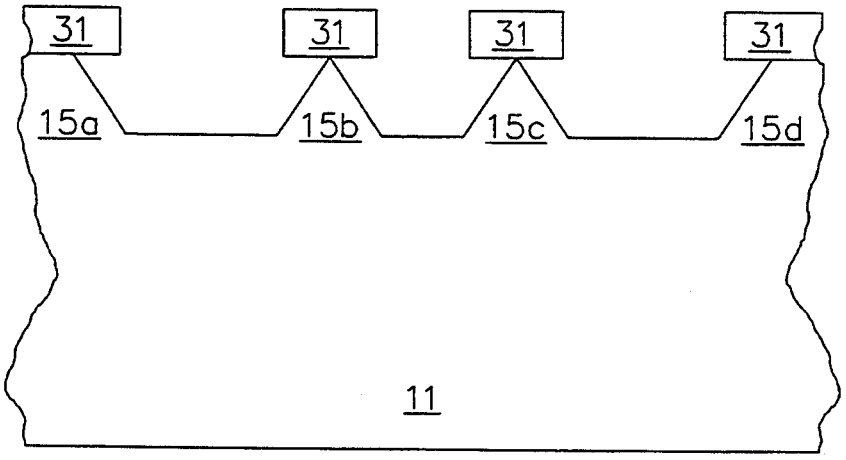
Figure 5C:
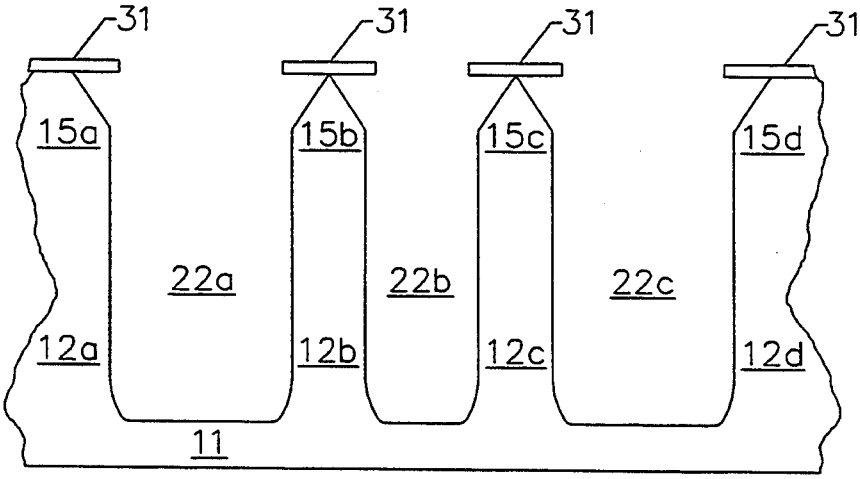
Figure 5D:
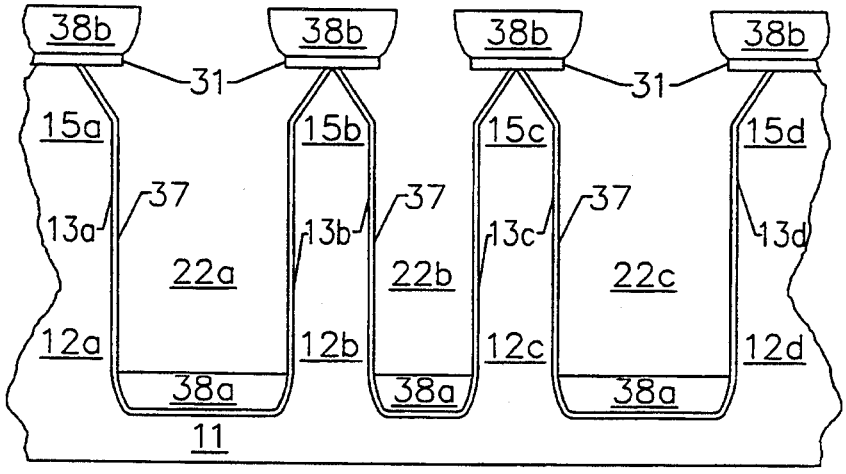
Figure 5E:
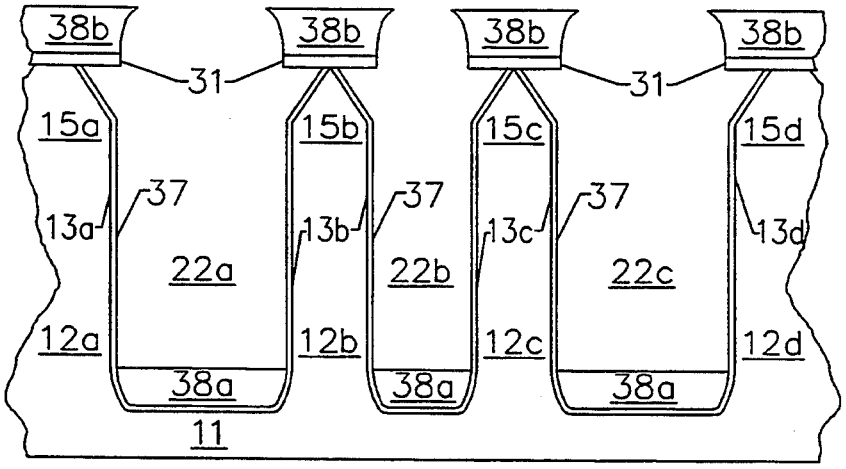

Referring now to FIGS. 5A–5I, a first detailed method for forming a field emitter using a "tips first" technique according to the invention is shown. As with FIG. 4A, a patterned oxide 31 is formed on a silicon substrate 11. Then, as shown in FIG. 5B, an anisotropic silicon etch is performed to form tips 15*a*–15*d*. Then, as shown in FIG. 5C, thin oxide layer 31 is grown and patterned and a deep anisotropic etch of silicon is performed to form trenches 22*a*–22*c*. Referring to FIG. 5D, an oxide layer 37 is formed on the exposed walls 13 and on the exposed surface of the substrate 11 and tips 15. An oxide layer 38 is also evaporated onto the substrate. As shown, this blanket evaporation forms oxide layers 38*a* at the bottom of trenches 22 and oxide layer 38*b* on top of oxide layer 31. The oxide layer 38*b* is then etched back as shown in FIG. 5E.

Figure 5F:
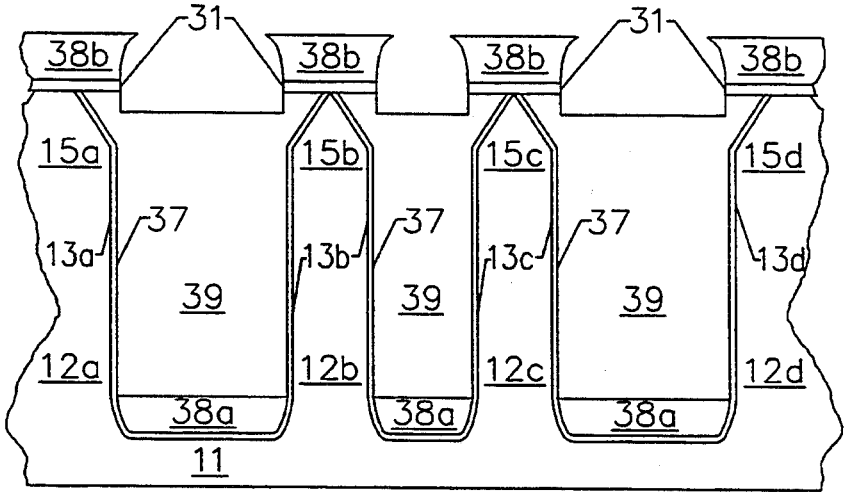
Figure 5G:
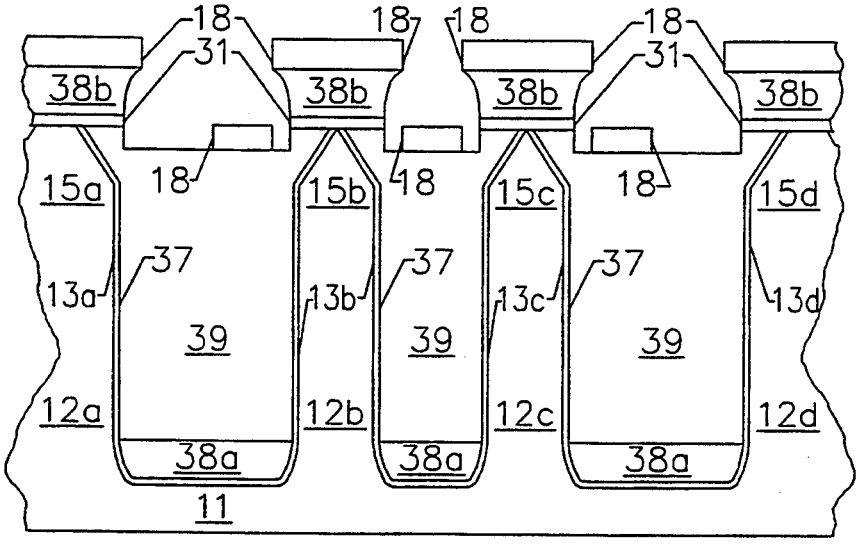
Figure 5H:
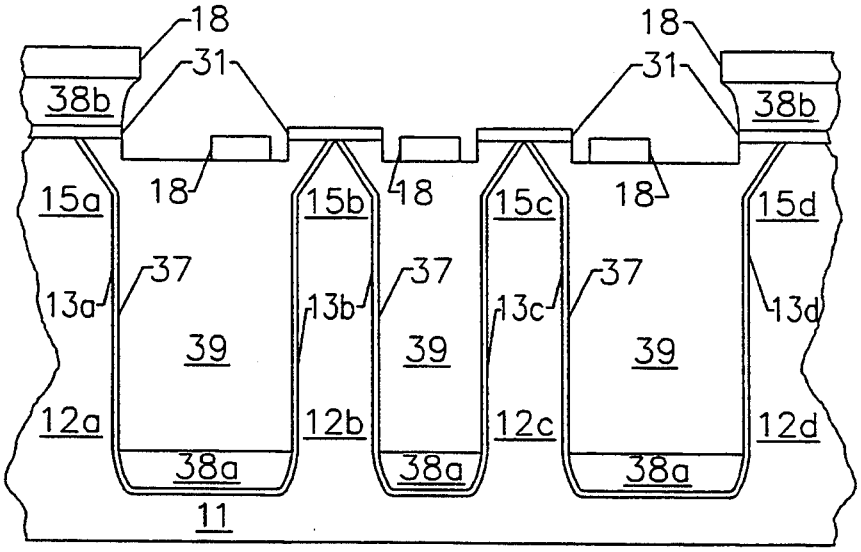
Figure 5I:
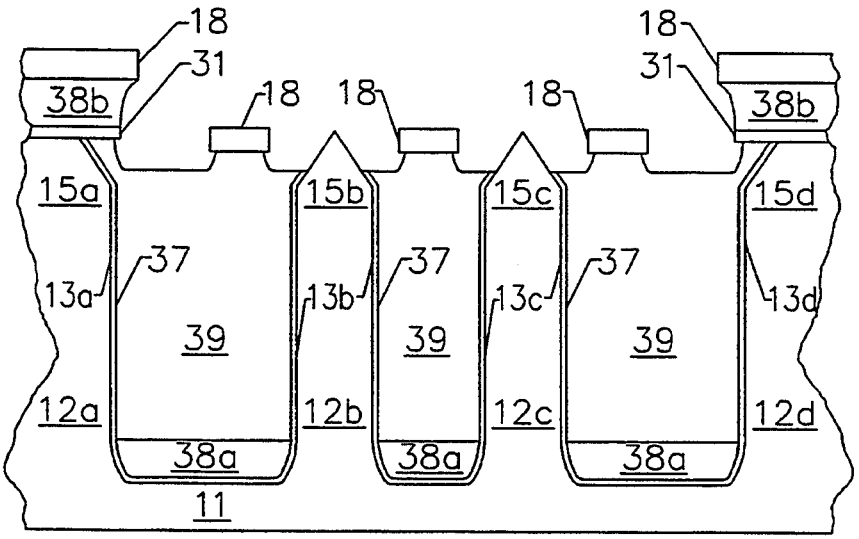

Then, as shown in FIG. 5F, a second insulating layer 39 fills the trenches 22. The second insulating layer may be a spun on polyimide which is then etched back or can be a second layer of silicon dioxide. Then, as shown in FIG. 5G, the extraction electrode metal 18 is evaporated onto the top of insulating layers 39 and 38*b*. An oxide etch is then used to remove the oxide layer 31 thereby removing oxide layer 38*b* and metal layer 18 thereon. Finally, the polyimide layer 39 is then etched to reexpose the tips as shown in FIG. 5I. It will be understood by those having skill in the art that the methods of FIGS. 4A–4H and 5A–5I provide methods for self-aligning the extraction electrode 18 to the tips 15. A small tip to extraction electrode spacing is thereby provided.

Figure 6A:
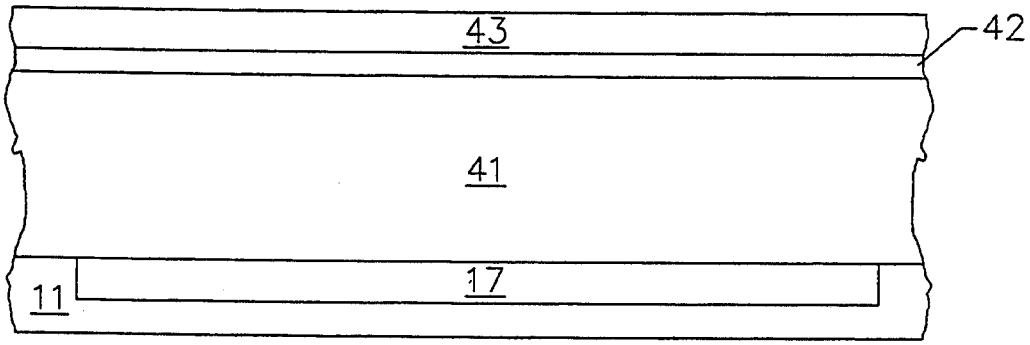
FIGS. 6A–6I illustrate cross-sectional views of a field emitter formed by an alternative embodiment of a "columns first" method, according to the present invention.

Referring now to FIGS. 6A–6I an alternative embodiment of a field emitter according to the present invention formed using a "columns first" technique will be described. The field emitter so formed is particularly suited for high frequency operation which requires low capacitance. As shown in FIG. 6A, a substrate 11 includes an emitter electrode 17 formed therein. Emitter electrode 17 may be formed by patterning the substrate 11 and depositing a conductor layer such as polysilicon or metal in the patterned substrate. Then, a second conductor layer 41 such as tantalum or titanium-tungsten alloy may be formed on substrate 11. An optional third conductor layer 42 may be formed on conductor layer 41. Conductor layer 42 may be a low work function material such as cesium, cermet, $LaB_6$, or TaN or other known low work function materials. Then, an insulating layer 43 is formed on the third conductor layer 42.

Figure 6B:
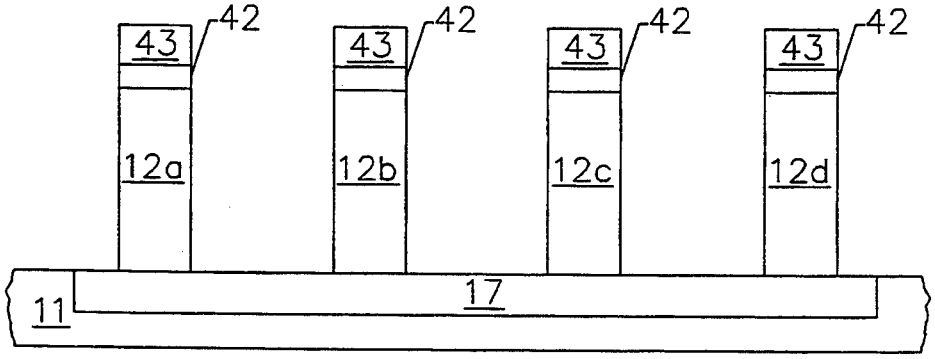
Figure 6C:
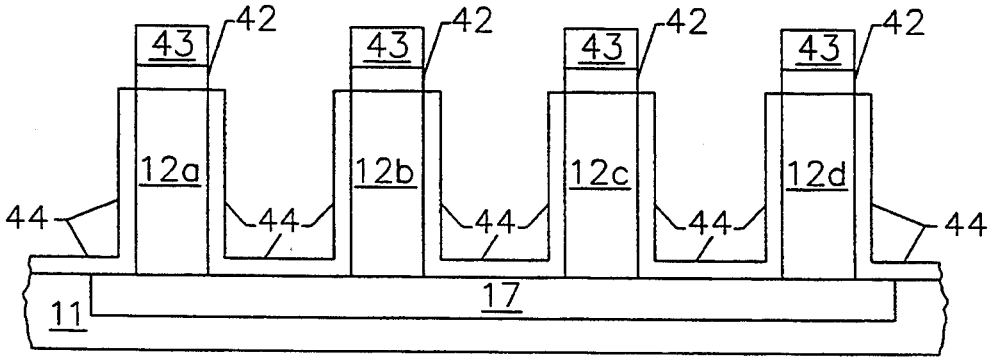

Referring now to FIG. 6B, layers 43, 42 and 41 are patterned and etched to form columns 12*a*–12*d*. As shown in FIG. 6C, an optional coating layer 44 of a conductor or insulator is formed on the walls 13 of columns 12 and on the face of substrate 11. Optional coating layer 44 may be an insulating layer in which case it may be formed by oxidizing the structure to form an oxide layer 44 on the surface thereof. Alternatively, optional layer 44 may be a metal layer, which may be formed using selective deposition of tungsten or other metals. As will be seen below, the use of the optional layer 44 allows the extractor electrode to be formed very close to the emitter tips.

Figure 6D:
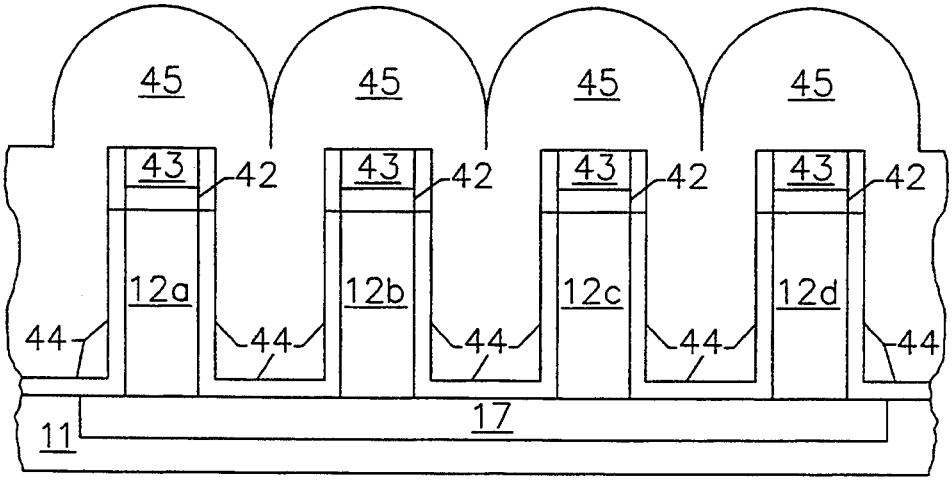
Figure 6E:
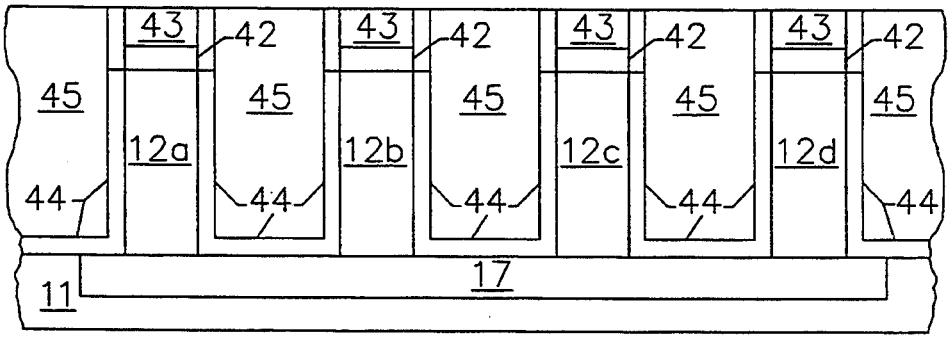
Figure 6F:
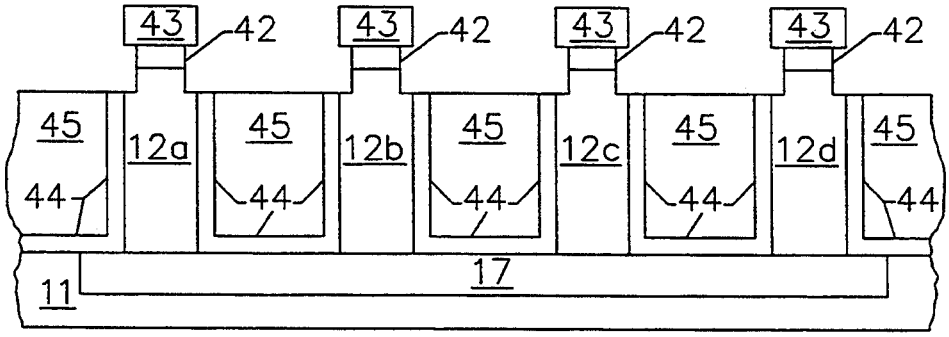
Figure 6G:
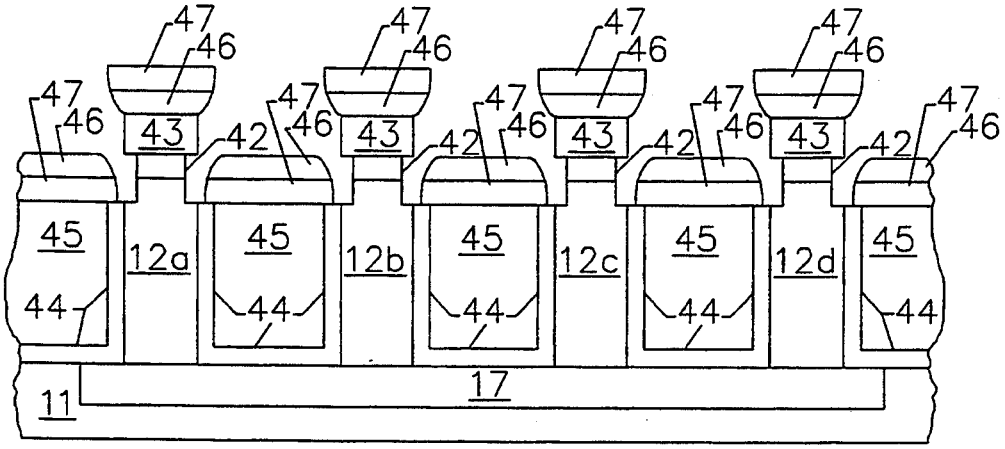
Figure 6H:
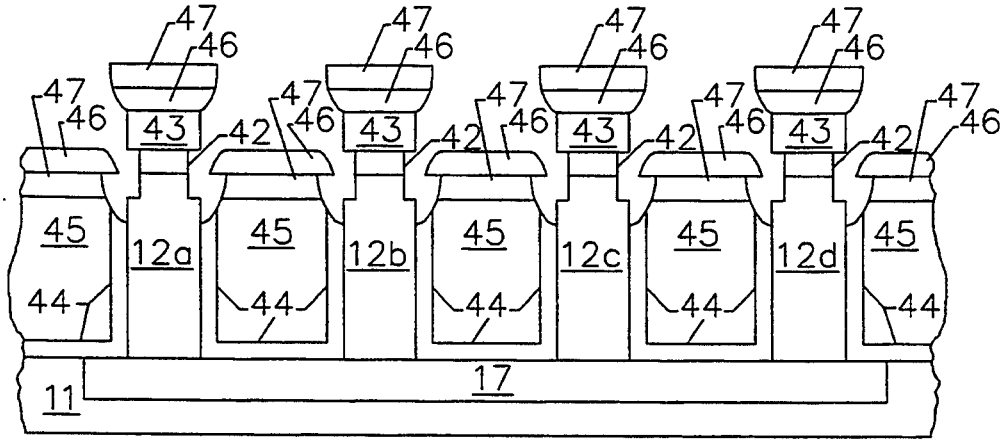

Referring now to FIG. 6D, an insulating layer 45 is then deposited to fill the exposed surfaces of the device. For example, low temperature oxide may be deposited. Then, as shown in FIG. 6E, the structure is planarized by polishing low temperature oxide 45. As shown in FIG. 6F, an etch-back of low temperature oxide 45, column 12 and conductor 42 is then performed. Then, as shown in FIG. 6G, a blanket evaporation of an insulating layer 46 and a conducting layer 47 is performed. Insulating layer 46 forms on insulating layer 45 and on insulating layer 43. The conducting layer 47 forms on insulating layer 46. Then, as shown in FIG. 6H, insulating layers 44, 45, and 47 are etched back.

Figure 6I:
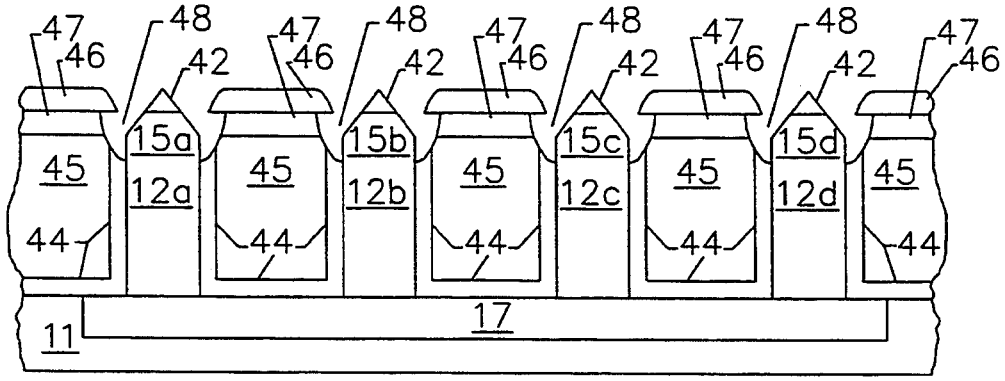

Finally, referring to FIG. 6I, insulating layer 43 is removed along with layers 46 and 47 thereon, and the tip is sharpened using an anisotropic etch. As shown in FIG. 6I, the completed structure includes extraction electrodes 47 which overhang into electron emissions gap 48 adjacent field emitter tip 15. The tip also includes a low work function material 42 at the point thereof. It will be understood by those having skill in the art that the structure of FIGS. 6I is well suited for very high frequency/low voltage applications.

Figure 7A:
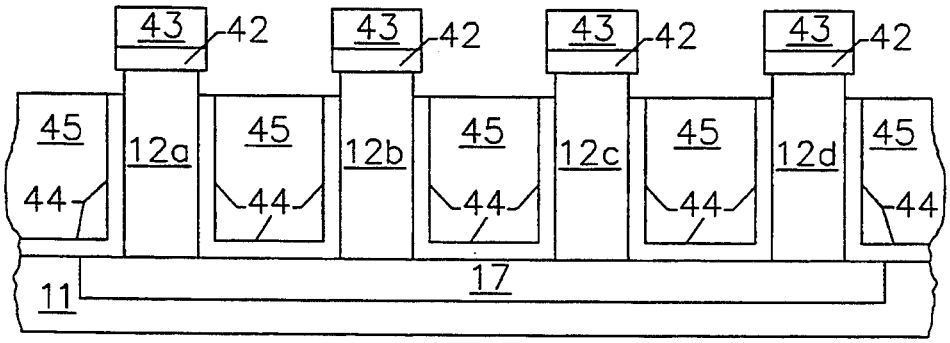
FIGS. 7A–7E illustrate cross-sectional views of a field emitter formed by an alternative method for forming field emitters from the structure of FIG. 6E, according to the present invention.
Figure 7B:
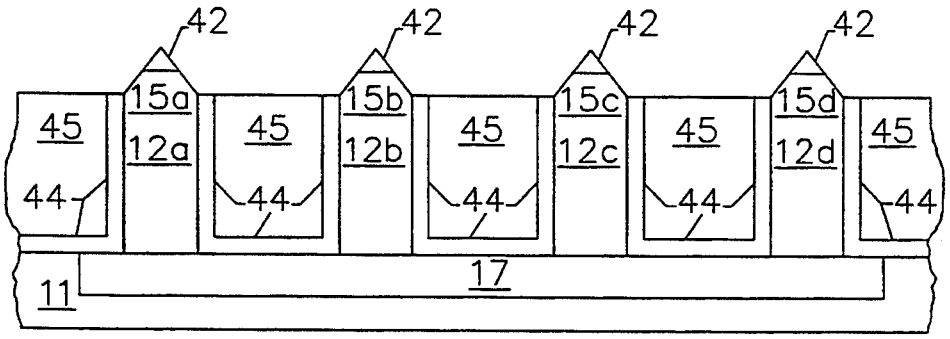
Figure 7C:
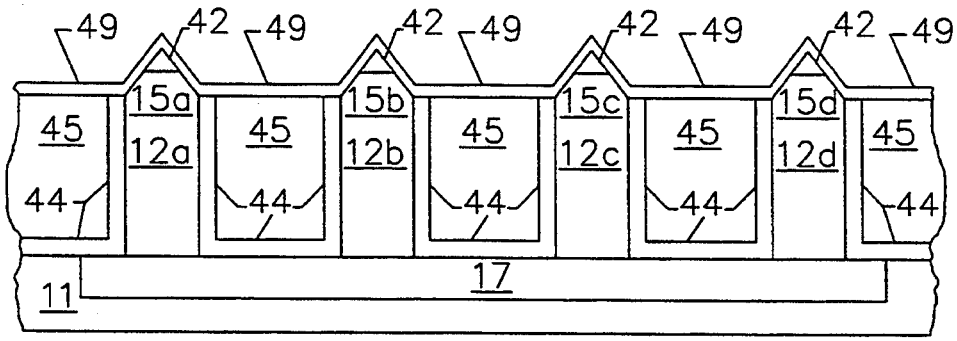
Figure 7D:
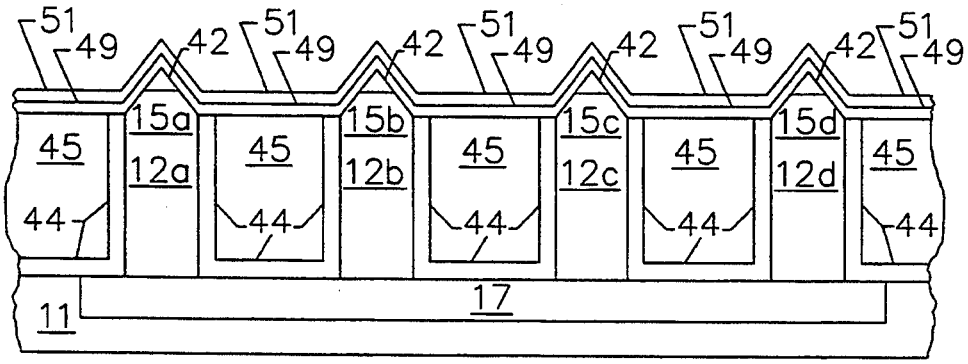
Figure 7E:
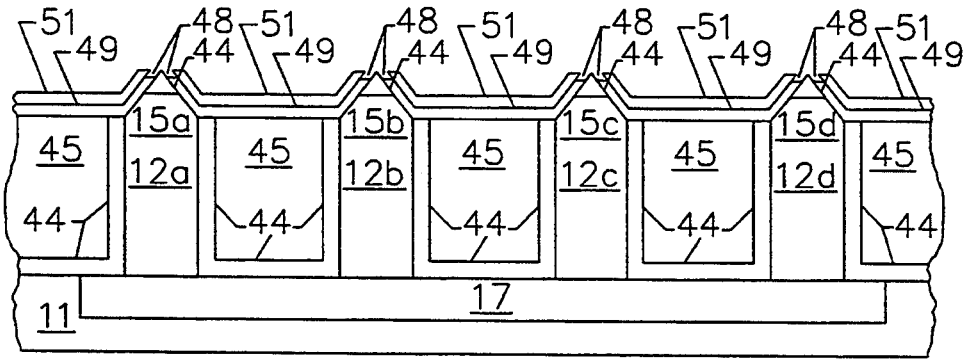

Referring now to FIGS. 7A–7E, an alternative method for forming field emitters from the structure shown in FIG. 6E will now be described. This method forms extractor electrodes which extend very close to tips 15. Although higher capacitance may result, these field emitters may operate at very low voltage. The emitters of FIG. 7E are formed by beginning with the sequence of operations shown in FIGS. 6A–6E. Then, as shown in FIG. 7A, insulators 44 and 45 are etched. Then, as shown in FIG. 7B, an anisotropic etch of columns **12*a*–12*d* is performed to form tips 15*a*–15*d*. In contrast to FIG. 6**, the tips are formed before the extractor electrode.

Then, referring to FIG. 7C, an insulating layer 49 such as silicon dioxide, silicon oxide or silicon nitride is blanket deposited over the exposed surface of the device. As shown in FIG. 7D, a conductor 51 is then blanket deposited over insulator layer 49. Finally, as shown in FIG. 7E, the structure may be planarized with photoresist and then etched back. Then conductor 51 and insulating layer 49 may be etched to form extraction electrode 18. As shown, a very small gap 48 is present between a low work function tip 44 and the extractor electrode 18. Very low voltage operation may be obtained, at the possible expense of higher capacitance. Accordingly, the field emitter structure of FIG. 7E may be used for display applications.

It will be understood by those having skill in the art that the field emitters of the present invention are typically encapsulated to form a functional device. The encapsulation may be vacuum encapsulation, inert gas encapsulation or electroluminescent gas encapsulation depending on the particular application. In order to encapsulate the device, a rim is typically built around groups of emitters to provide a well for a vacuum cavity. The rim may be formed of silicon dioxide with an optional silver glass overlayer. A cover may then be placed over the emitter array in a vacuum and sealed. The cover may be aligned by pins or other mechanical means or optically aligned to the underlying substrate prior to sealing. Typically, heat is used to seal the cover.

Other encapsulation techniques may use known metal-to-metal bonding techniques such as the technique described in U.S. Pat. No. 5,009,360 entitled *Metal-to-Metal Bonding Method and Resulting Structure*, assigned to the assignee of the present application. Depending upon topmost layer of the field emitter and the bottom layer of the cover, the bonding may be metal-to-metal, dielectric-to-dielectric, metal-to-dielectric or dielectric-to-metal. It will also be understood by those having skill in the art that the bonding need not take place in vacuum, because the mini-vacuum chambers are typically self pumping due to the presence of titanium electrodes in the chambers. Accordingly, upon energization of the field emitter, any residual gas may be self-pumped and removed.

Two encapsulation techniques will now be described, although it will be understood by those having skill in the art that other techniques may be used. The technique of FIG. 8 uses a reflowable glass. The technique of FIG. 9 uses a solder bond.

Figure 8:
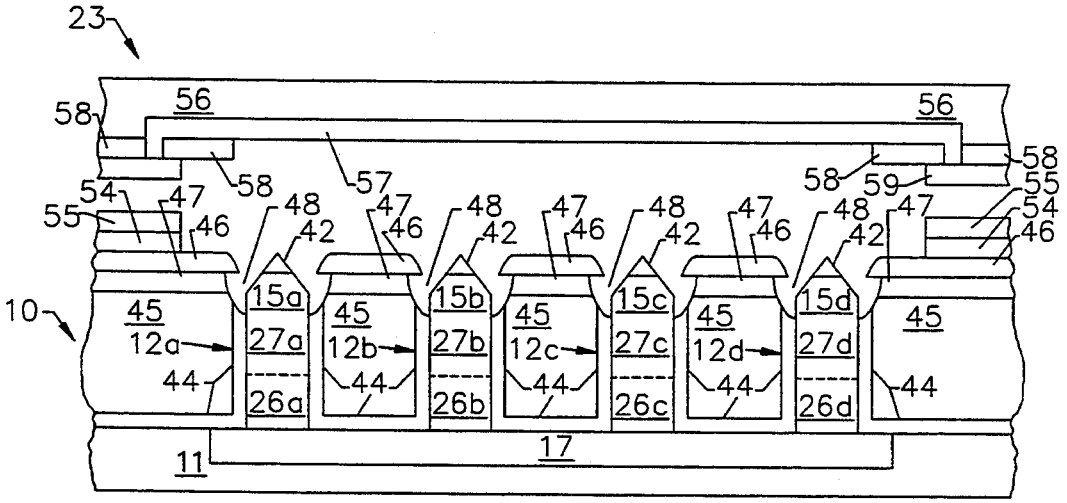
FIG. 8 illustrates a cross-sectional view of an encapsulated field emitter according to the present invention, using reflowable glass.

Referring now to FIG. 8, a technique for encapsulating the field emitter of FIG. 6I will now be described. As shown, an optional insulating layer 54 may be formed to insulate the cover from the extraction electrode 18 if so desired. Optional insulating 54 may be formed, for example, by blanket depositing silicon nitride over the entire exposed surface of the emitter. A layer of adhesion material 55 such as borophosphosilicate glass or polyimide may then be blanket deposited on nitride layer 34 and the adhesion material layer 55 and insulating layer 54 may then be photolithographically patterned and etched to produce the structure as shown in FIG. 8. Glass frit sealing may also be used.

A cover 23 may also be formed using known techniques. The cover may be formed on a second substrate 56 and may include insulating layers 58 and metal layers 57 to provide interconnection patterns if desired. A second layer of adhesion material 59 may be provided in alignment with the first layer of adhesion material 55. The field emitter 10 and the cover 23 may then be placed adjacent one another, with the adhesion materials 59 and 55 contacting one another, and heated in vacuum to encapsulate the structure. Accordingly, the combination of the adhesion material layers 55 and 59 and the insulating layer 54 form a mechanical standoff which also is an electrical insulator. Planarization of the two pieces may be required prior to heating unless a reflowable glass is used. It will also be understood that collectors, interconnects, display array grids and other structures may be built into the cover. The cover may also be formed of a glass substrate, upon which layers of indium-tin oxide and phosphor are formed, with the phosphor layer adjacent the field emitter tips.

Figure 9:
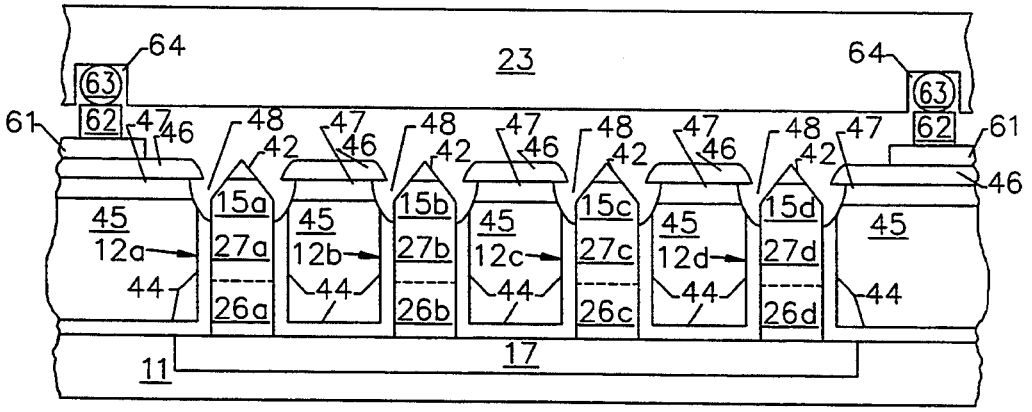
FIG. 9 illustrates a cross-sectional view of an encapsulated field emitter according to the present invention, using a conductive rim.

Referring now to FIG. 9, another structure for encapsulating the emitter of FIG. 6I is shown. As shown, an electrically conductive path is formed between the extraction electrode 46 and the cover 23. The conductive path may be formed by forming a metal layer 61 on extraction electrode and forming a conductive rim on metal layer 61. It will be understood by those having skill in the art that layers 61 and 62 may be formed on field emitters 10 by spinning on a layer of polyimide to planarize the exposed surfaces of the emitters, blanket depositing layers 61 and 62, patterning layers 61 and 62 and then removing the spin on polyimide layer. Cover 23 includes a groove 64 therein, with a plurality of solder balls 63 formed within the groove. Upon heating, solder balls 63 form a vacuum tight seal to encapsulate the field emitters and also forms a conductive path to the cover 23.

It will understood by those having skill in the art that thin film structures may also be used as alignment guides for the cover. For example, columns of deposited material may be formed in horizontal thin film covers or down into etched trenches or V-grooves. These may be especially useful in loose tolerance aligning such as would be required for aligning phosphor pixels and conductive grids to field emitters in a display array. Rough alignment may be obtained with mechanically based pin or groove assemblies, against which the cover slides and then rest. It will also be understood by those having skill in the art that a reactive material such as titanium may be used in the inside of the cover or on the extractor electrodes to getter contaminants during the sealing process and during the operation of the device to provide pure vacuum encapsulation.

It will also be understood by those having skill in the art that the cover 23 may be formed upon a substrate, such as a silicon wafer or a glass wafer, and separated from the substrate after the bonding process is complete. Separation may be accomplished by etching a release layer such as a thick zinc or aluminum release layer, or even etching away the silicon substrate itself. Alternatively, the silicon substrate may be left to provide upper level circuitry if desired. It may be necessary to remove upper portions of the substrate to provide access to the extractor electrodes. Alternatively, back side etching to connections on the field emitter and electrical connections under the cover to electrical pads on the top of the cover may also be possible.

It will also be understood that low work function materials such as cesium may be encapsulated into the vacuum cavities in small quantities to enhance electron emission. Heating of these devices under bias after vacuum encapsulation could thereby promote improved emission by causing the low work function atoms or molecules to accumulate on the emitter tips.

Figure 10A:
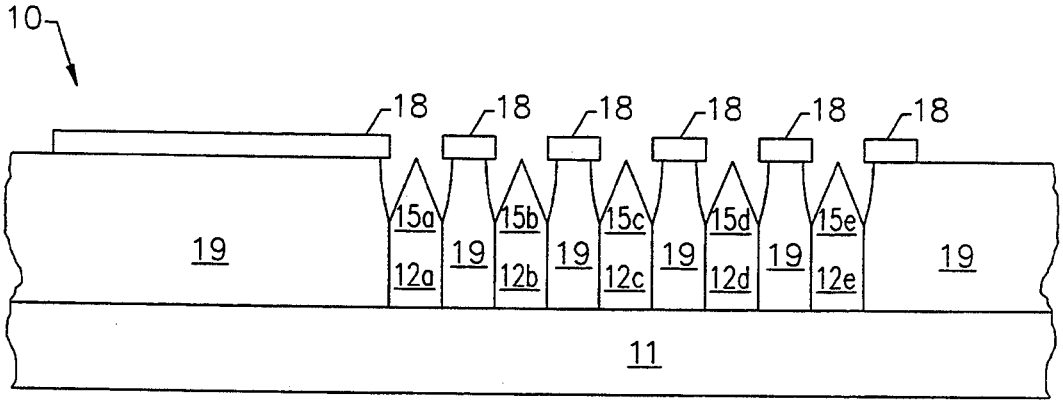
FIGS. 10A–10F illustrate cross-sectional views of an alternative method for encapsulating a field emitter, according to the present invention.
Figure 10B:
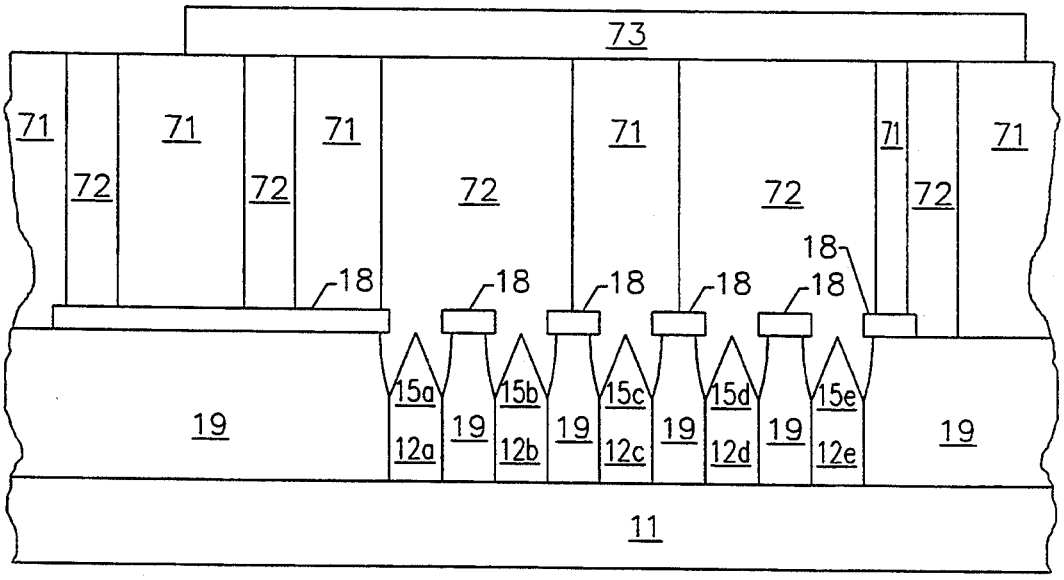

Referring now to FIGS. 10A–10F, yet another process for encapsulating the emitter structure of the present invention will now be described. This technique allows individual one or ones of the field emitters to be encapsulated in "mini-vacuum chambers". As shown in FIG. 10A, the process begins with an emitter 10 according to any of the techniques described above, and including a substrate 11, columns 12, tips 15, insulating layer 19 and extractor electrode 18. Referring to FIG. 10B, a filler layer 72 is deposited and patterned to expose the desired emitter tips. As shown in FIG. 10B, emitter tips **15*a* and 15*b* are grouped together and exposed, emitters 15*d* and 15*e* are grouped together and exposed, and emitter tip 15*c* is covered. A low temperature oxide layer 72 may then be deposited and planarized to form the structure of FIG. 10B. A top layer 73** such as a titanium layer may be formed on the filler layer over the device area.

Figure 10C:
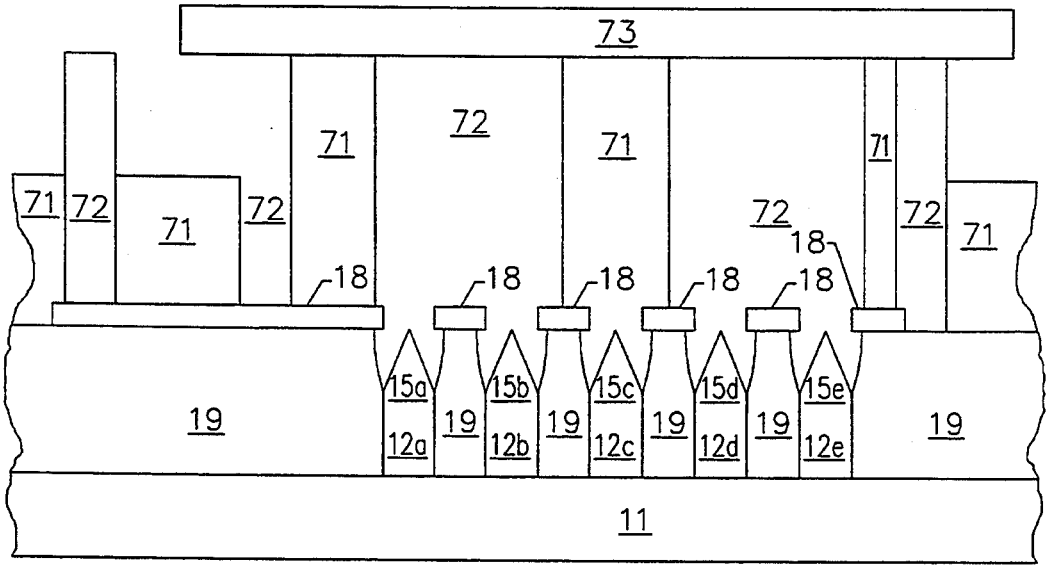
Figure 10D:
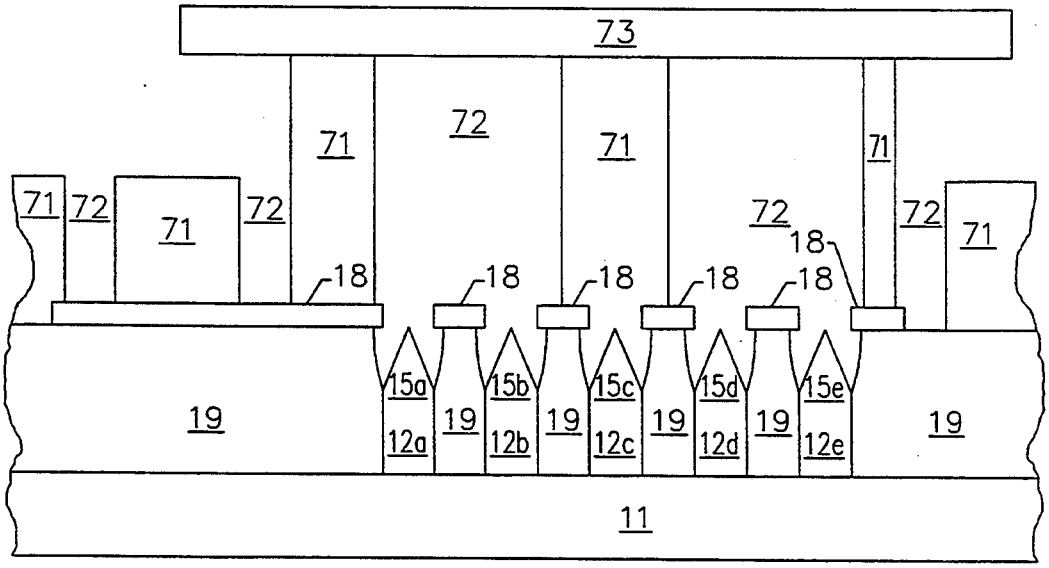

Then, referring to FIG. 10C, layer 71 may be patterned and etched outside the device area. Then, referring to FIG. 10D, layer 72 may be removed. It will be understood by those having skill in the art that layer 73 may be a separate layer of titanium or may be a titanium layer on another substrate or any other layer.

Figure 10E:
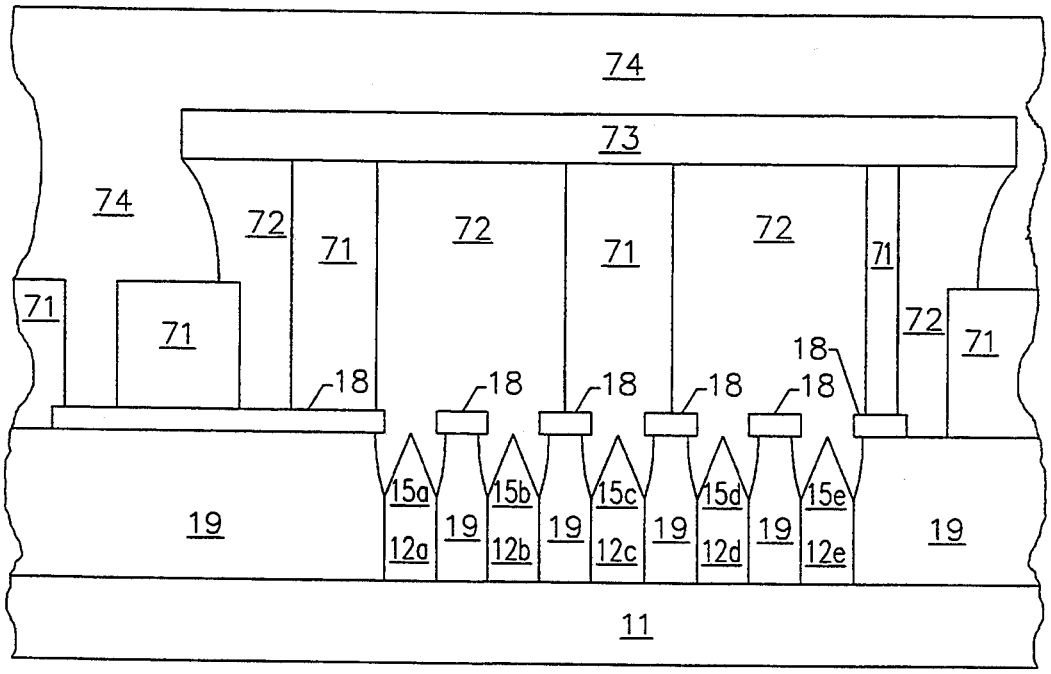

Then, referring to FIG. 10E, a sealing metal 74, such as titanium is evaporated over the entire structure. Finally, as shown in FIG. 10E, the sealing layer 74 may be patterned and etched to expose and isolate the extraction electrode. Accordingly, many encapsulation cavities 75 may be formed with the cover being supported by pillars 76.

Figure 10F:
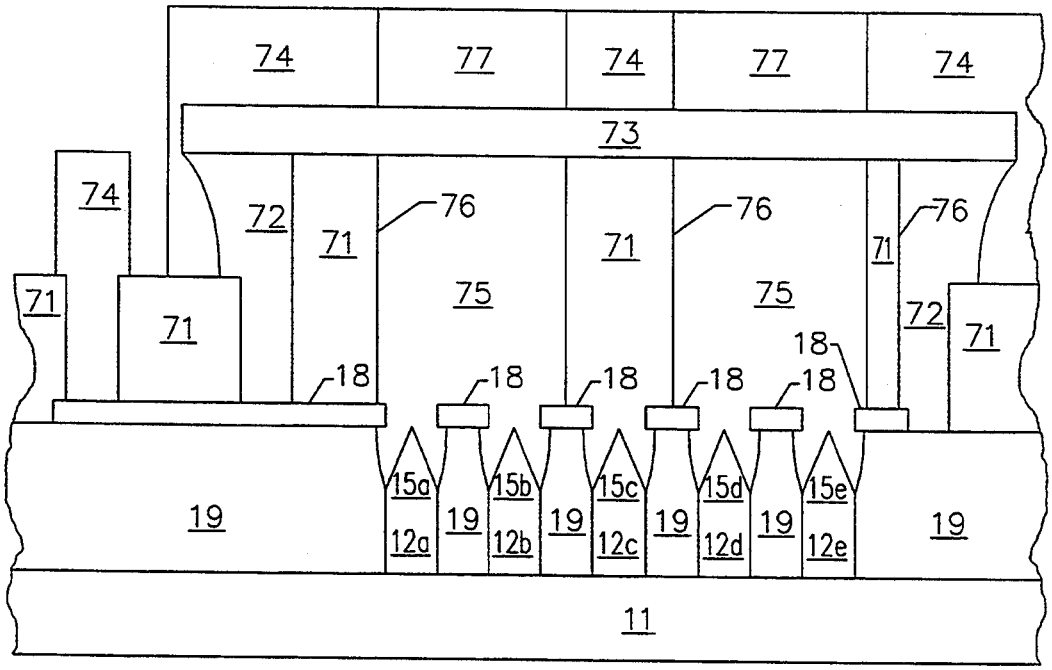

It will be understood by those having skill in the art that if a reactive metal such as titanium is used for the cover, added vacuum pumping of the many vacuum chambers 75 may be achieved. It will also be understood that portions of sealing layer 74 may be removed where it is not desired, for example for the top of the cover in a display. As shown in FIG. 10F, for display applications, patterned pixels 77 of different color phosphors may be deposited within the wells formed in sealing layer 74 to create isolated pixels if desired. Overlayers of thin conductors may be used to apply bias if required. A grid of metal lines may also be used to individually address or bias pixels if desired, although pixels may also be turned on and off at the gate level. It will also be understood by those having skill in the art that phosphors may be substituted for, or added to, any of the conductor layers described herein.

Figure 11A:
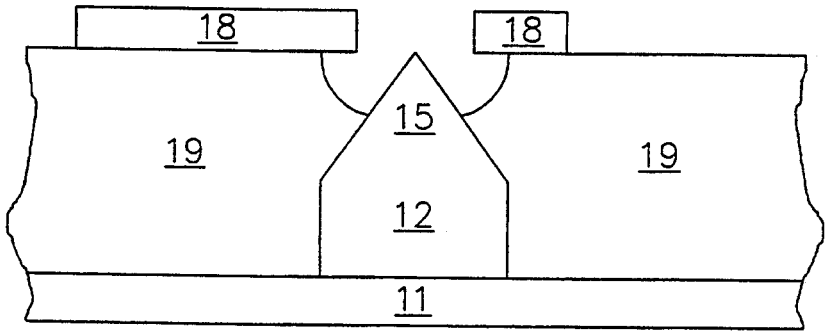
FIGS. 11A–11J illustrate cross-sectional views of another method for encapsulating a field emitter, according to the present invention.

Referring now to FIGS. 11A–11J, an alternative technique for encapsulating individual field emitters will now be described. For purposes of this description, only a single field emitter is shown in FIG. 11A, having an elongated column 12 formed on substrate 11 and an emitter tip on the column 12 and an insulating layer 19 surrounding the column. An extractor electrode 18 is formed on the insulator 19.

Figure 11B:
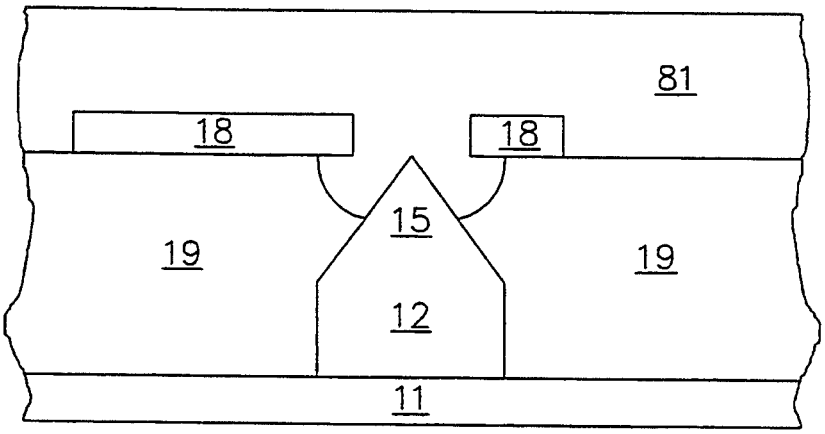
Figure 11C:
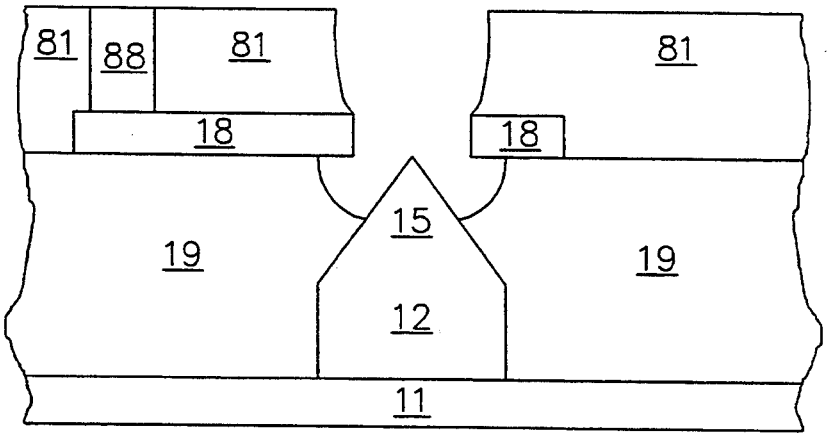
Figure 11D:
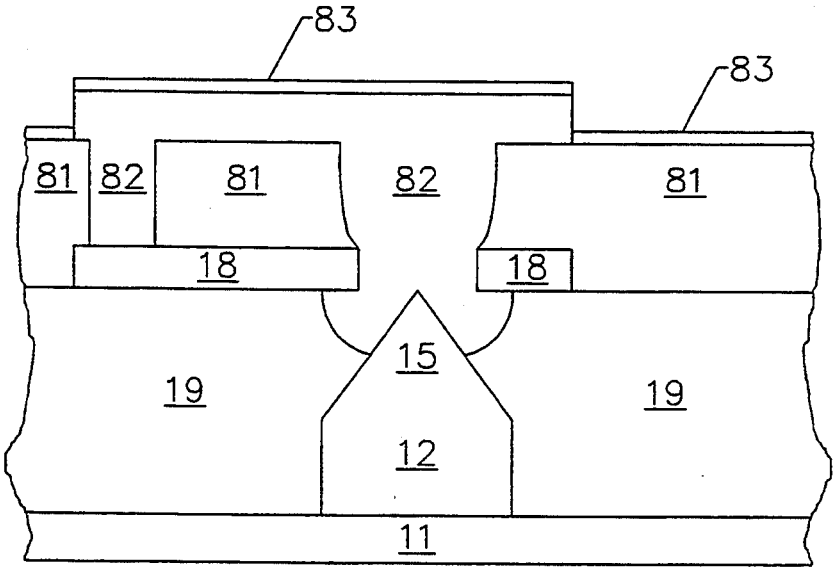
Figure 11E:
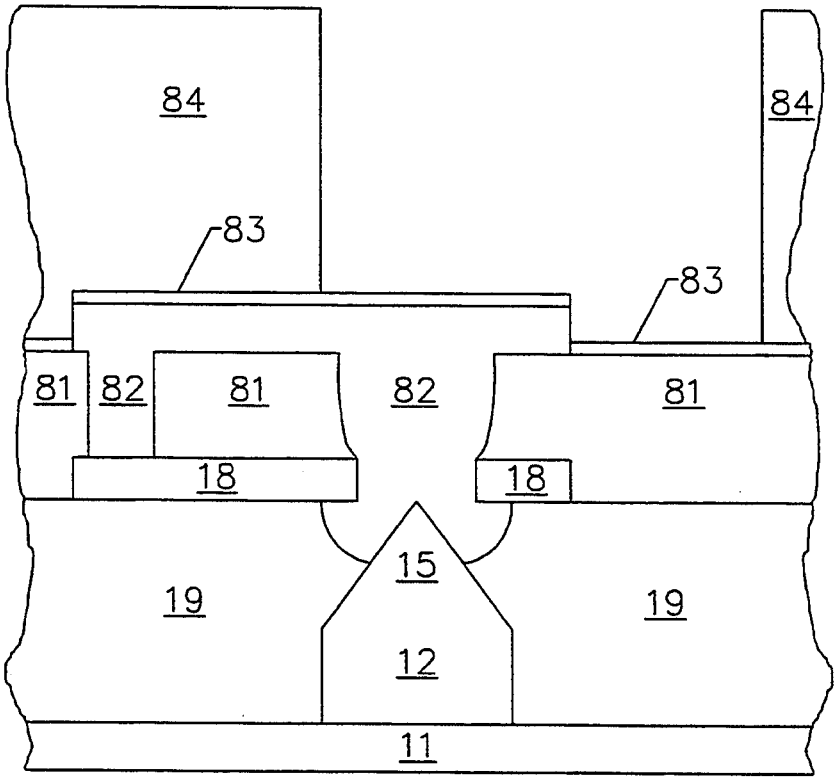
Figure 11F:
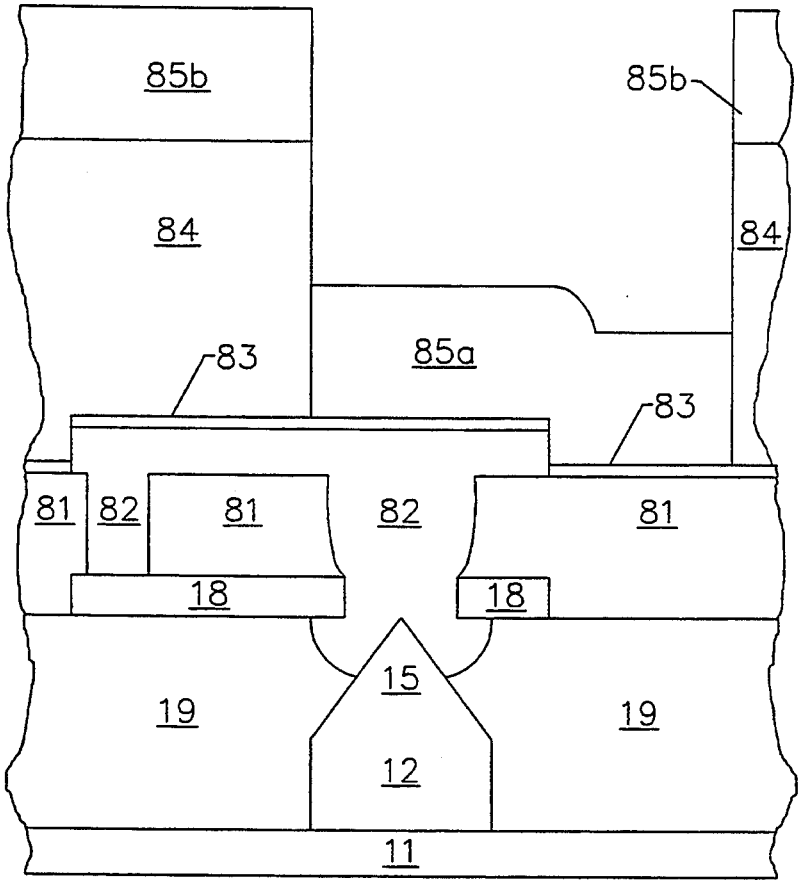

Referring to FIG. 11B, a layer of low temperature oxide 81 is formed over the exposed emitter tip and extractor electrodes. Layer 81 is then patterned to expose the emitter tip and contact 88 for extractor 18, as shown in FIG. 11C. Then, as shown in FIG. 11D, photoresist 82 is spun on and patterned. A thin layer 83, for example titanium, is deposited on the photoresist 82 and low temperature oxide 81. A second layer of photoresist 84 is then deposited and patterned as shown in FIG. 11E. A thick layer 85 such as a thick layer of titanium is then deposited on the photoresist layer 84 (portion **85*b*) and on titanium layer 83 (portion 85*a*). As shown, portion 85*a* of titanium layer on titanium layer 83** forms a thick cantilever to assist in the encapsulation of the emitter.

Figure 11G:
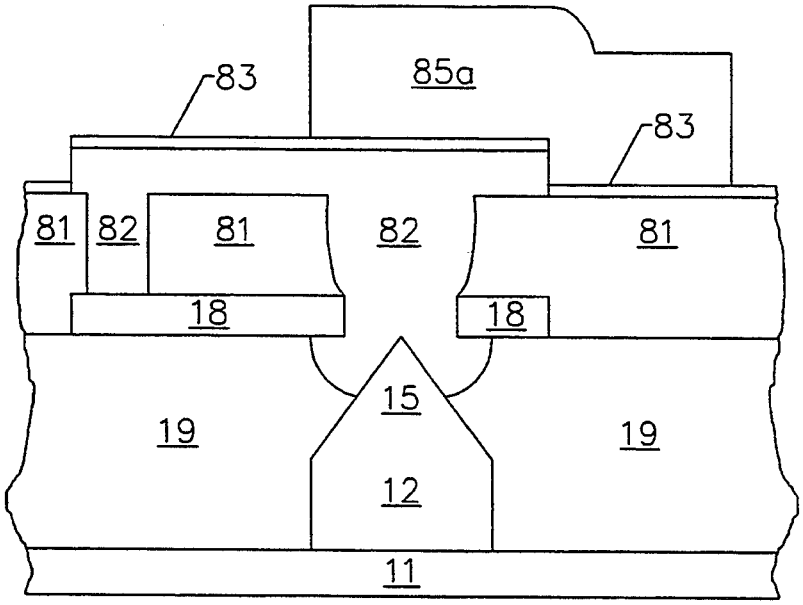
Figure 11H:
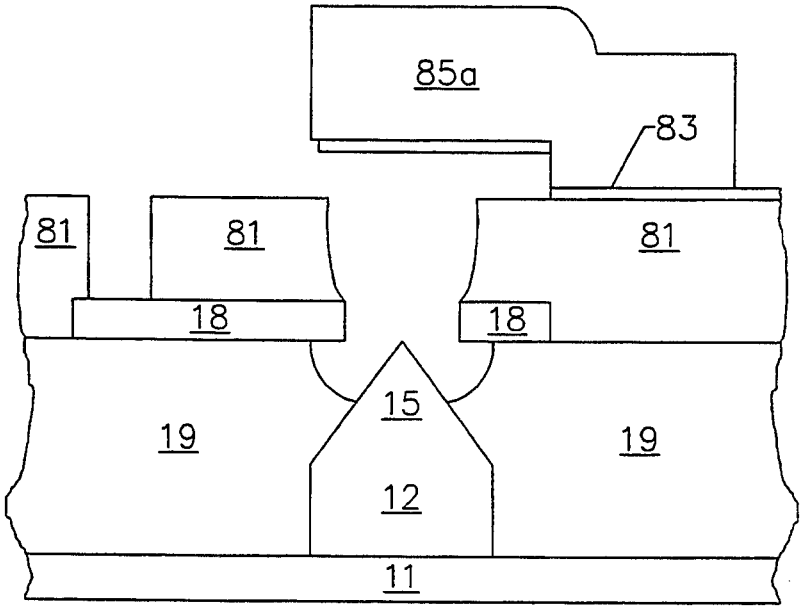
Figure 11I:
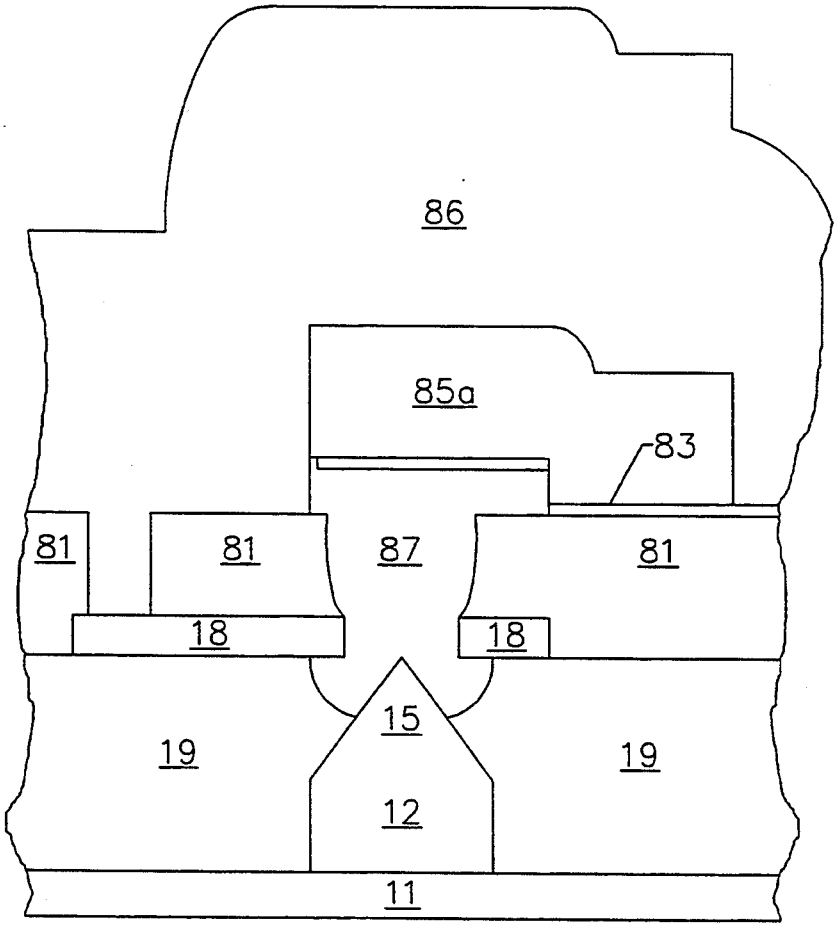
Figure 11J:
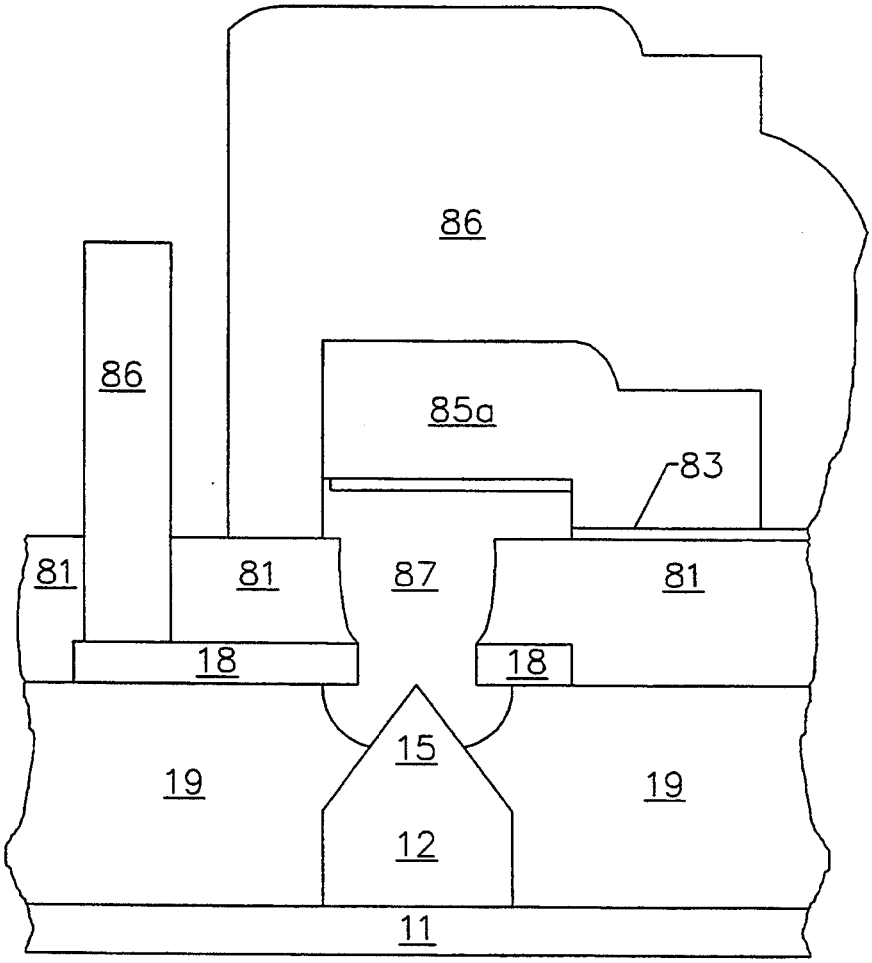

Then, referring to FIG. 11G, the titanium layer 85 is lifted off by dissolving photoresist layer 84. The thin titanium layer 83 is then etched and the photoresist layer 82 is then removed, as shown in FIG. 11H. Accordingly, layer **85*a* forms a thick cantilever over the opening. Then, as shown in FIG. 11I, a metal or other layer 86 is evaporated over the structure to form an individual vacuum chamber 87. As shown in FIG. 11J, layer 86** may be patterned if necessary to expose the extractor electrode. Accordingly, individual encapsulation may be provided.

Referring now to FIGS. 12A–12I an alternative encapsulation technique is shown. This technique provides deep grooves which allows independent top side access to an extractor electrode and a top electrode.

Figure 12A:
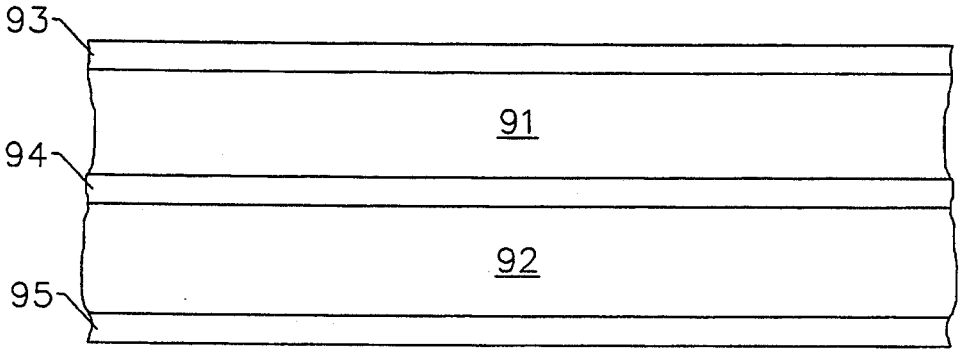
FIGS. 12A–12I illustrate cross-sectional views of yet another encapsulation method, according to the present invention.
Figure 12B:
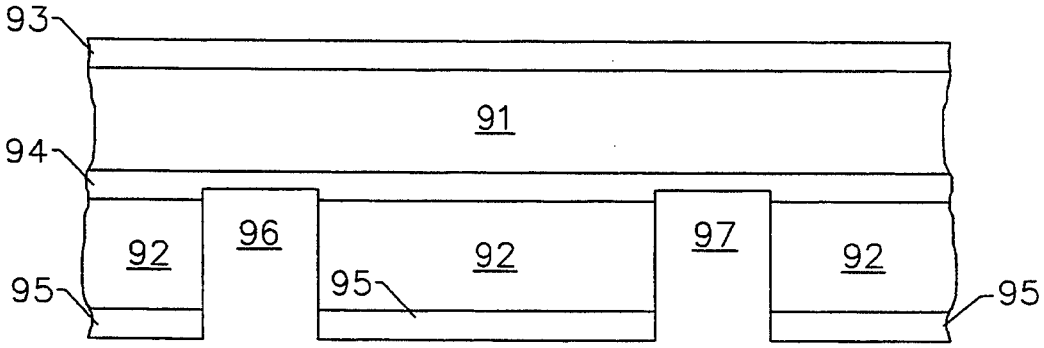
Figure 12C:
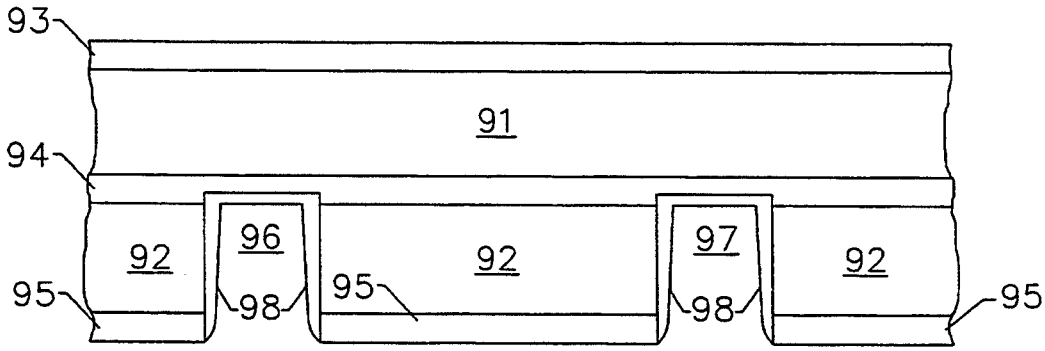
Figure 12D:
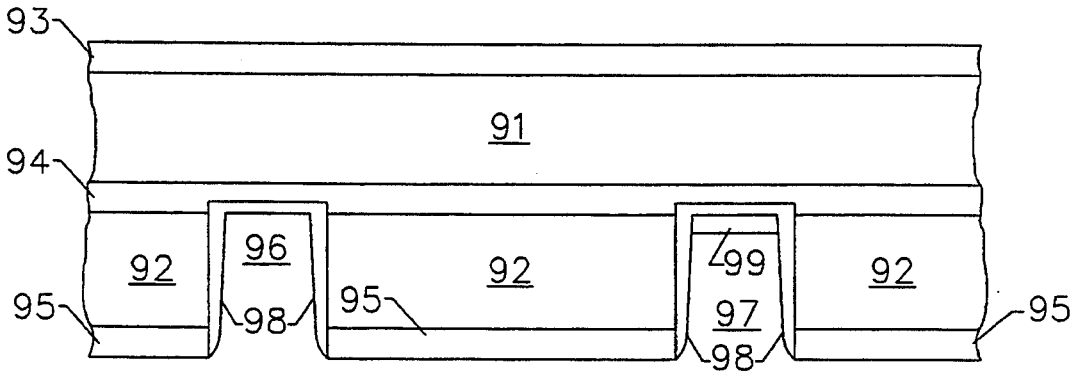
Figure 12E:
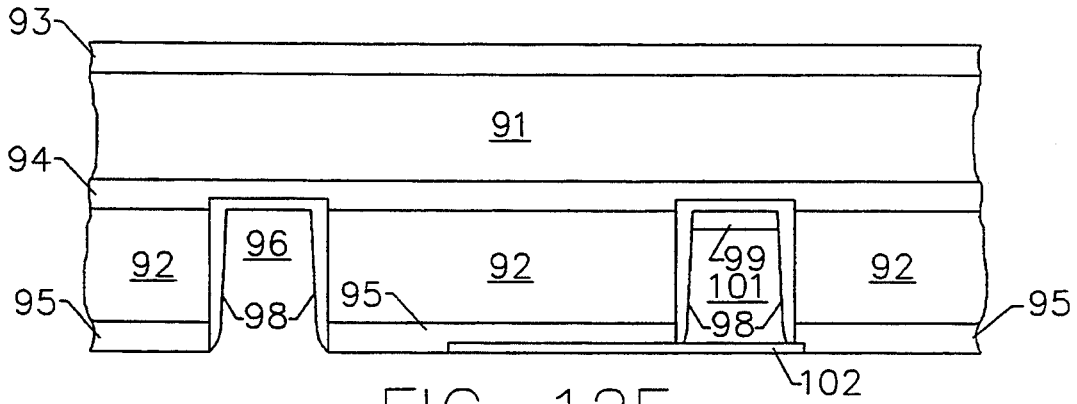

Referring to FIG. 12A, a pair of silicon wafers 91 and 92 may be oxidized and oxide bonded to one another to form oxide layers 93, 94, and 95. Oxide 95 and wafer 92 may then be etched to form cavities 96 and 97 therein (FIG. 12B). The sidewalls of cavities 96 and 97 may then be oxidized, as shown in FIG. 12C by using low pressure chemical vapor deposition oxide 98. A layer 99 of copper/chromium may then be formed in trench 97 as shown in FIG. 12D, using evaporation or other known techniques. Then, as shown in FIG. 12E, electrodeless plating of metal 101, such as nickel, palladium or copper, may be formed on layer 99. A layer of titanium/tungsten 102 may then be formed as shown.

Figure 12F:
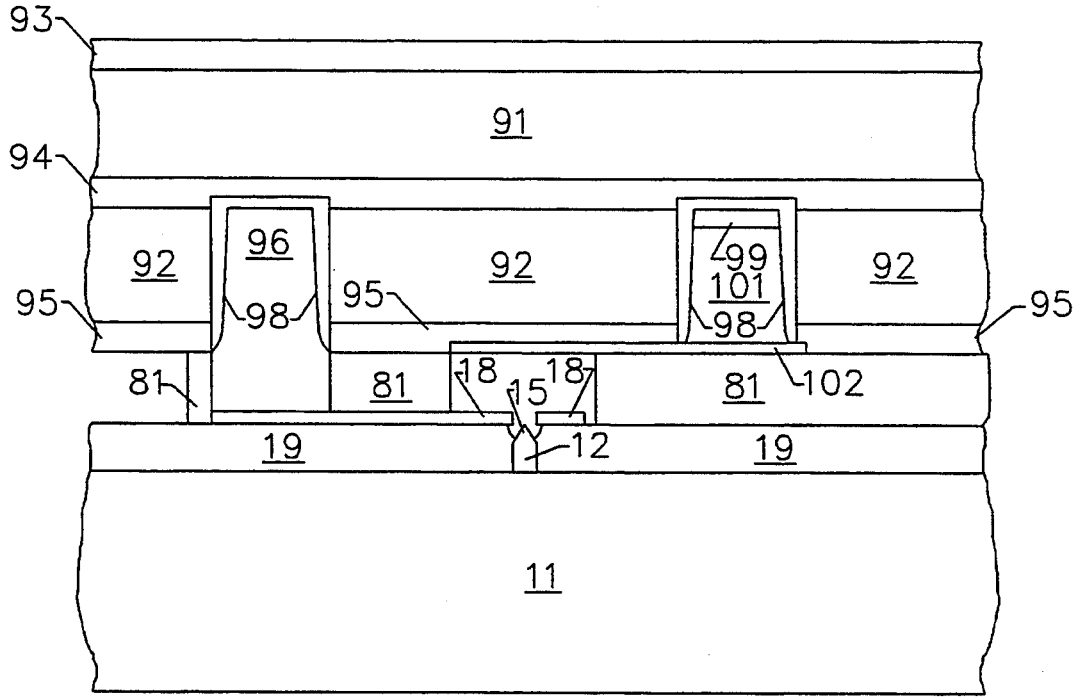
Figure 12G:
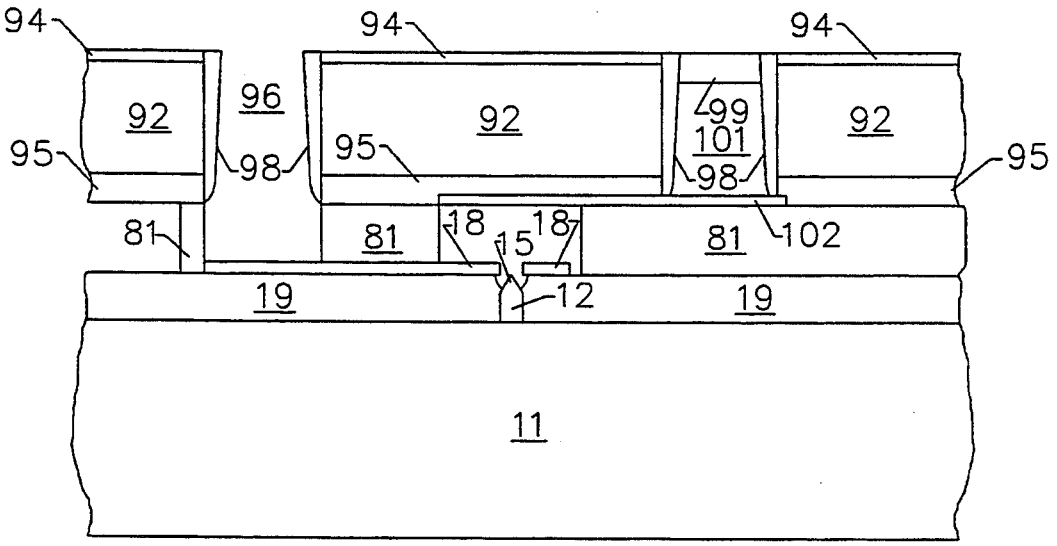
Figure 12H:
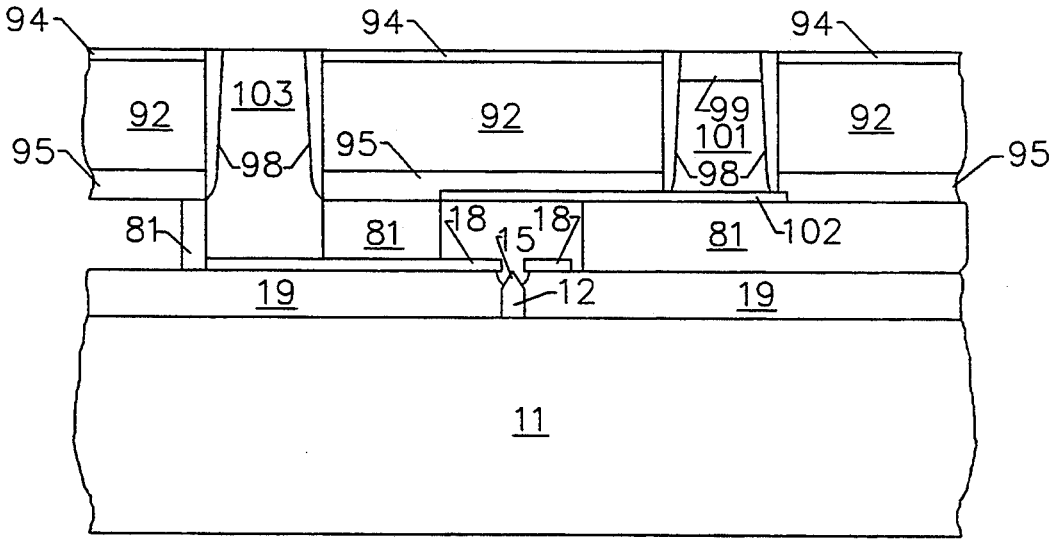
Figure 12I:
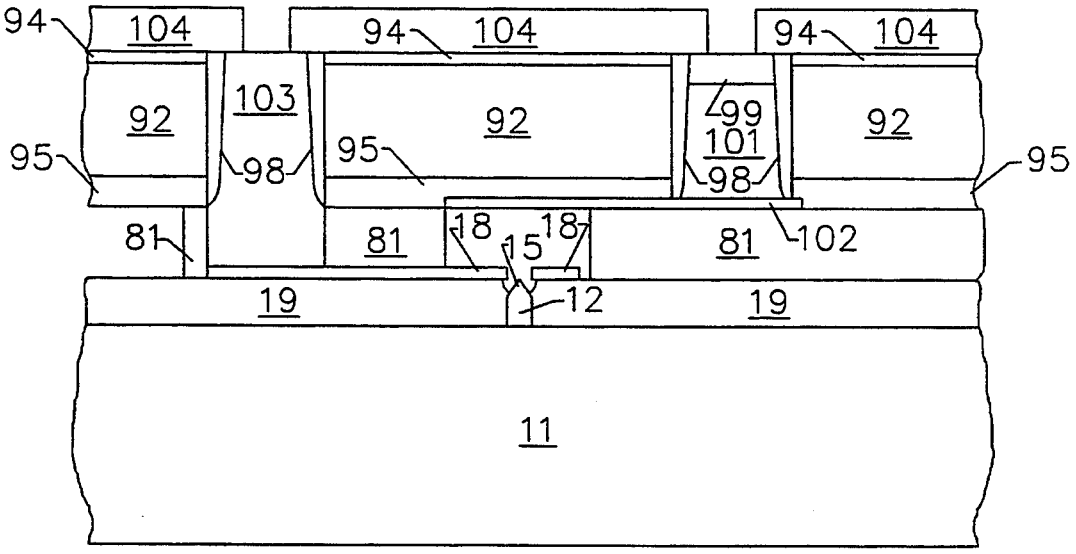

Referring now to FIG. 12F, the cover is then joined to a field emitter using one of the techniques also described. Then, as shown in FIG. 12G, oxide layer 93 and first wafer 91 are etched away. As shown in FIG. 12H, electrodeless plating may then be used to form metal via 103. A new oxide layer 104 may then be formed and patterned as shown in FIG. 12I. As such, multilevel interconnections and integration may be provided.

Figure 13:
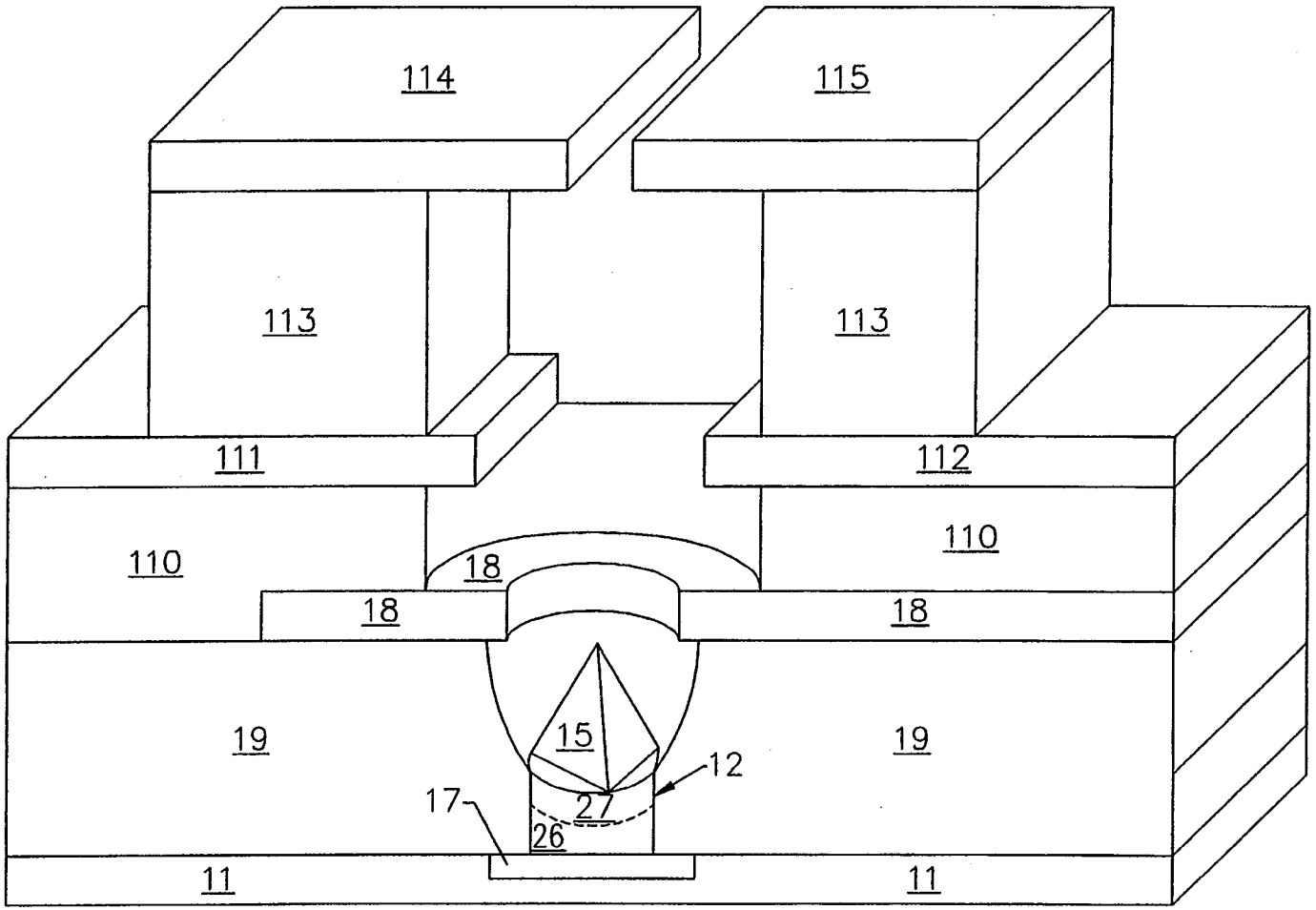
FIG. 13 illustrates a field emitter having deflection electrodes and split anodes, according to the present invention.

It will also be understood by those having skill in the art that multiple electrode layers may be formed on the extraction electrode according to the present invention. FIG. 13 illustrates such a field emitter with deflection electrodes and split anodes. As shown, a dielectric layer 110 is formed on extraction electrode 18. Dielectric layer is typically a thin dielectric layer on the order of 1 μm thick. Then, a pair of deflection electrodes 111 and 112 are formed on dielectric layer 110. A second dielectric layer 113 is formed on the deflection electrodes 111 and 112, and a pair of anodes 114 and 115 are formed on the dielectric layer 113. Encapsulation is then provided using one of the methods described above, or any other encapsulation method.

The device of FIG. 13 has a high transconductance without the need to modulate the tips 15. A DC bias is applied between extractor 18 and electrode 17 so that electrons are emitted at all times. The deflection electrodes 111 and 112 are used to shift the electron beam between anodes 114 and 115. Binary shifting between anodes 114 and 115 may be used to provide a switch. Alternatively, linear shifting between anodes 114 and 115 may be provided to allow linear operation of the device. Linear operation may be provided because the electron beam is relatively large compared to the space between anodes 114 and 115, and because dielectric 113 is typically on the order of one hundred times thicker than dielectric 110. It will be understood by those having skill in the art that additional layers of deflection electrodes may be added to shape the electron beam and increase the device's transconductance. The device of FIG. 13 may also be used as a display with three or more arrays of different colored phosphors being formed as the split anodes using transparent metal and three deflection electrodes for deflecting electrons to the specific anode (phosphor).

It will be understood by those having skill in the art that thin film Einzel lenses may be fabricated on the emitters described herein by depositing alternating layers of dielectric and conductor and then patterning and etching the electron beam columns. This approach may also be used to create deflection electrodes and other electron beam control structures.

It will also be understood that two field emitter array structures may be placed opposite each other via wafer-to-wafer bonding or another bonding layer such as silver, glass or reflowable dielectric or metal, to produce a bidirectional current flow device resembling an insulated gate field effect transistor (IGFET). It will also be understood that controls for switching pixels in displays need not be full on or off. Small voltages (for example less than 50 volts) may be used by simply adding the added voltage required to fully turn on the pixel to a background bias voltage near the emitter turn on threshold. Field emitter displays of one or a few pixels may be used as alternatives to light emitting dioxides but with full multicolor capability. Colors may be addressed either by multiple leads, digital decoders and/or a resistor or diode matrix which switch the colors based on serial parallel data or a voltage or current level.

Referring now to FIGS. 14A–14L, an alternative method for forming field emitters and encapsulating the field emitters according to the present invention is shown. The method described in FIGS. 14A–14L is optimized for the formation of flat panel display devices, such as might be used in high definition television or other display applications. For display applications, it is typically required to have resistors in the field emitter columns in order to limit the current for each emitter. The resistors must all be of the same value so that the current, and therefore the brightness, of each pixel is the same. The sequence of operations shown in FIGS. 14A–14L meets this requirement. An edge emitter is also provided, rather than a tip emitter, to provide a diffuse emitted current which impinge on the entire pixel.

Figure 14A:
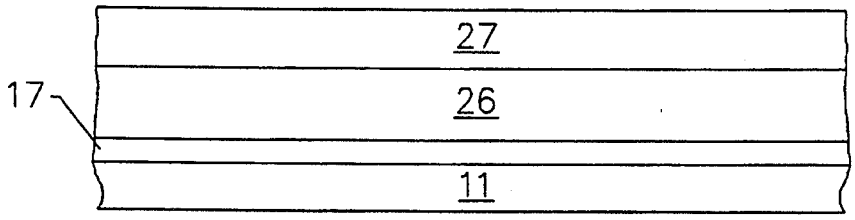
FIGS. 14A–14M illustrate cross-sectional views of a method of encapsulating a field emitter display, according to the present invention.

Referring now to FIG. 14A, an emitter electrode 17 is formed on a substrate 11. The substrate may be glass or other relatively inexpensive substrate materials. A layer of amorphous silicon 26 is then formed on the emitter electrode 17 to a desired thickness. As is well known to those having skill in the art, amorphous silicon may be heavily doped, preferably gold doped, to provide a resistive layer. Plasma deposition may be used to form layer 26, with the doping performed simultaneously with the deposition or after the deposition. Finally, a conductive layer 27 such as tungsten or titanium-tungsten is formed on the amorphous silicon layer 26. Layer 27 preferably is thick and is a low resistance material.

Figure 14B:
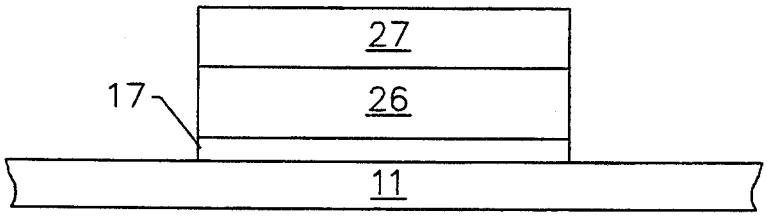
Figure 14C:
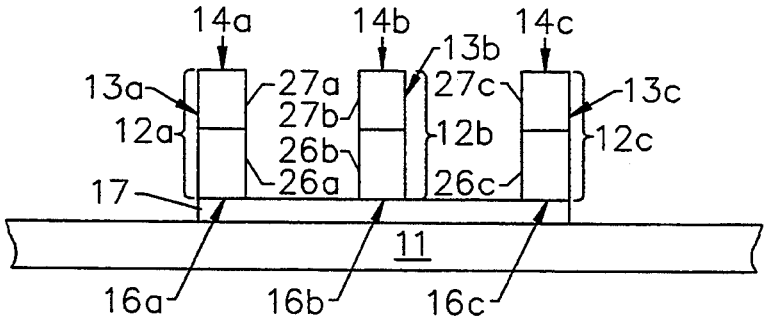

Then, referring to FIG. 14B, a group of pixels may be patterned using standard photolithographic techniques. Then, referring to FIG. 14C, individual field emitter columns 12 are patterned using standard photolithographic techniques. Accordingly, three field emitter columns **12*a*–12*c* are provided with each including a resistive bottom portion 26*a*–26*c*, the resistances of which are very well controlled, and a conductive (low resistance) top portion 27*a*–27*c***. It will be understood that the patterning does not change the value of the resistive bottom portion, so that uniform current is provided in all emitter columns.

Figure 14D:
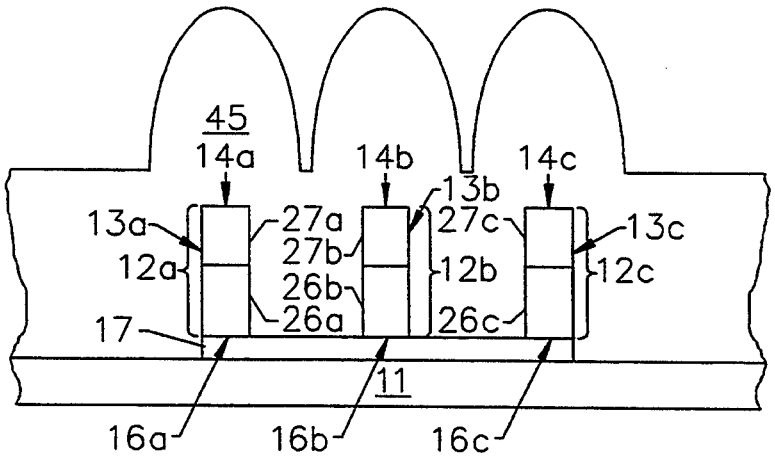
Figure 14E:
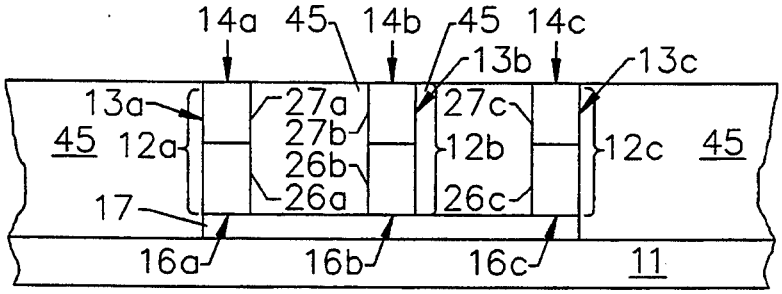

Then, referring to FIG. 14D an insulating layer 45 such as silicon dioxide is formed, for example by chemical vapor deposition. Then, as shown in FIG. 14E, polishing is used to planarize the device. Polishing preferably stops at the metal layer 27 and may be continued down through the metal layer 27. This polishing does not change the resistance value of the resistive bottom portion. Accordingly, even if the conductive portion 27 is of variable thickness, uniform resistance is still achieved.

Figure 14F:
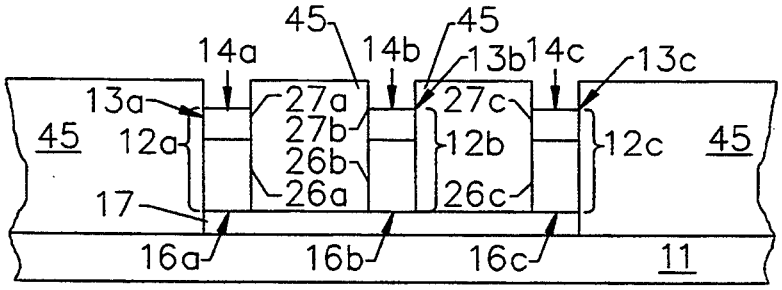
Figure 14G:
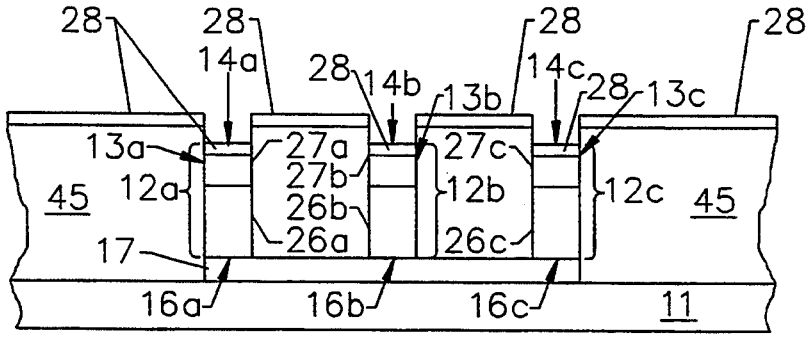
Figure 14H:
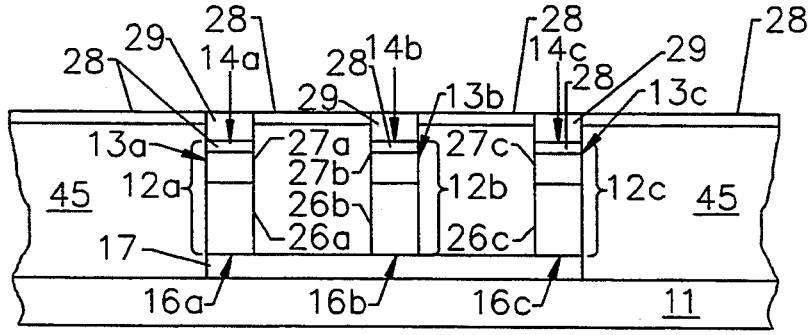
Figure 14I:
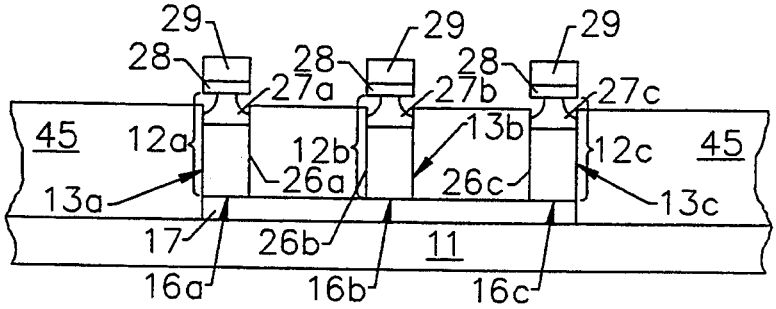
Figure 14J:
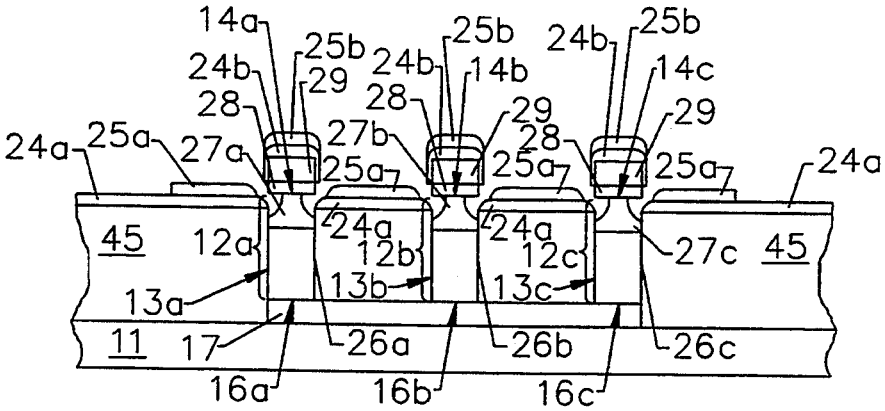

Referring to FIG. 14F, the metal layers **27*a*–27*c* are then further etched and a thin, nonconformal layer of nickel 28 with an optional low work-function coating is then deposited thereon as shown in FIG. 14G. A layer 29 of nitride is then conformally deposited on the metal layers 28 by chemical vapor deposition or other known techniques. Photoresist planarization is used and etched back to the nitride layer 29 as well as metal layer 28 on top of insulating layer 45 as shown in FIG. 14H. The insulating layer 45 is then etched to expose the columns. The metal layer 27*a*–*c* is then etched, as shown in FIG. 14I. An insulating layer 24*a*, 24*b*, of silicon dioxide, aluminum oxide or another insulator, is then evaporated, followed by a metal layer 25*a*, 25*b*. The insulating layer 29, metal layer 25*b* and insulating layer 24*b*** are then removed by etching, as shown in FIG. 14K.

Figure 14K:
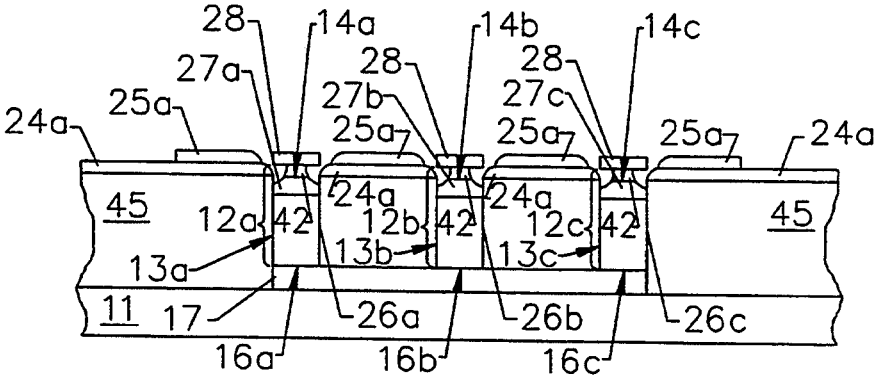

As also shown in FIG. 14K, the emitter tip is optionally sharpened. A low work function material 42 may be optionally added, as shown in previous embodiments. A flat nickel cap 28 with optional low work function coating, is optionally formed so that emission occurs at the edge of the cap 28 in the horizontal direction. This diffuse edge emission is useful in display applications and can provide more uniform emitter-to-emitter emissions than point emission when large substrates are used. The cap 28 may also include a coating of low work function material.

It will be understood by those having skill in the art that many different materials can be used to form the top 27 of the columns 12. For example, the top may be formed of nickel, TI:n or other conductive material or may be formed of a low work function material. It will also be understood that the edge emitter cap 28 may be formed in circular, rectangular or other shapes as necessary. The bottom portion 26 of column 12 may be formed of any resistive material. The resultant structure forms a resistor on the bottom of each column to control the display current, and an edge emitting cap which is optimized for display applications.

Figure 14L:
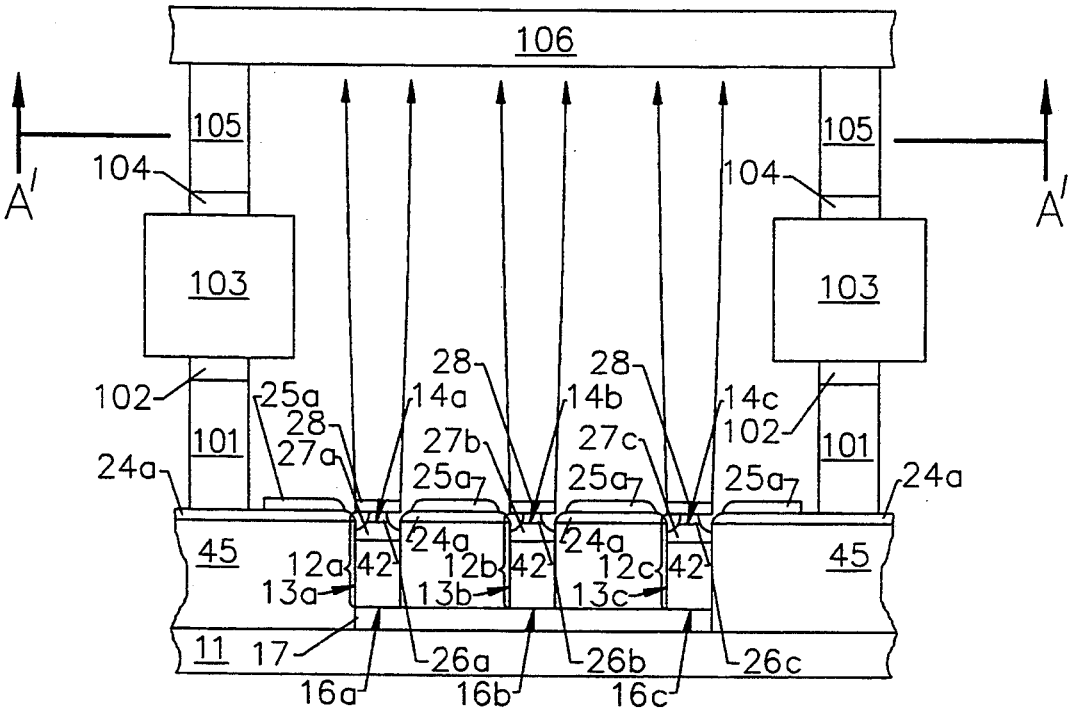
Figure 14M:
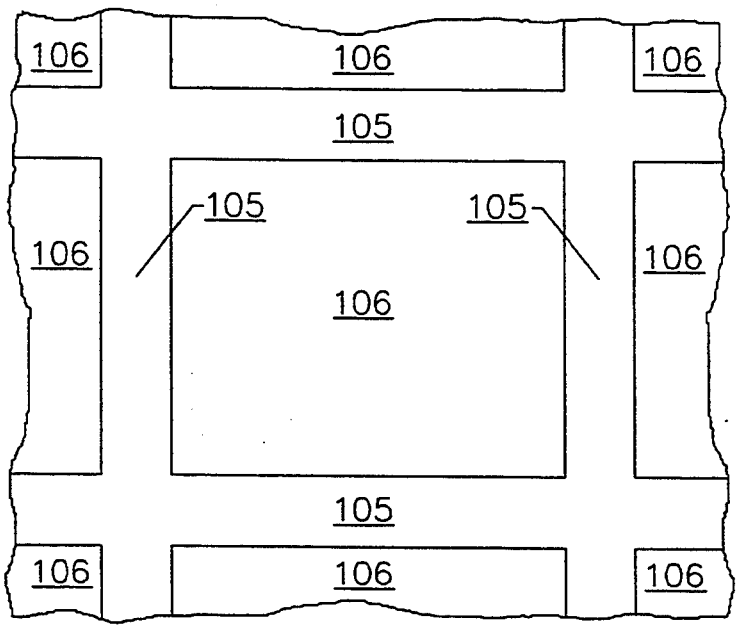

Referring now to FIG. 14L the structure of FIG. 14K may then be encapsulated to form a display device. As shown, a display screen 106, for example formed of glass with a phosphor coating, includes a pattern of standoffs 105 in an egg-crate pattern or grid. The standoffs 105 may be spaced so that a group of emitters are encapsulated in a single mini-vacuum chamber as shown in FIG. 14L. The grid standoffs 105 form a set of four intersecting walls which surround a group of emitters as shown in FIG. 14M. The solid grid standoffs provide greater structural rigidity than typical column standoffs.

The standoff may be, for example, 50 μm thick and may be formed of glass, metal, polyimide or almost any other material. The egg-crate pattern on the standoff may be etched using well known photolithographic techniques. The standoffs typically include a metal or other conductor layer 104 which can be used to help focus the emitted electrons towards the display screen 106.

A corresponding egg-crate standoff 101 may also be formed on field emitter 10. This standoff may also include a conductor 102. An optional spacer, such as beaded glass about 900 μm thick may be used to space the screen 106 from the field emitter 10. The spacer is preferably leaded glass but may also be silicon dioxide, polyimide, metals, silicon or other materials. The spacer allows a large separation between the screen and the emitter, without requiring long etch cycles. The large spacers are preferably transparent to a viewer of the display. The spacers may only be required for large area displays. It will be understood by those having skill in the art that in particular applications one or more of elements 101, 102, 103, 104 and 105 may not be needed.

In summary, the present invention provides a new device structure for field emission diodes or transistors with exceptionally low parasitic capacitance for high frequency operation. Moreover, the field emitters may be operated at higher voltages with less risk of breakdown due to an increased dielectric thickness. Alternatively, many design variations with lower turn on voltage may be produced with less of a capacitance penalty than many other field emitter designs. Self-aligned fabrication methods may be provided so that the extractor is self-aligned to the emitter columns and small pyramids or wedges may be built on tall columns with small emitter-extractor spacings. This permits low voltage operation without producing the high capacitance normally associated with small devices.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed is:

1. A microelectronic field emitter comprising:

a substrate;

an elongated vertical pillar on said substrate, extending therefrom, said pillar having a wall, a resistive bottom portion adjacent said substrate and a conductive top portion opposite said substrate;

a coating layer on said wall;

an electron emitting element on said conductive top portion;

an insulating layer on said substrate, extending adjacent said wall; and at least one electrode on said insulating layer, extending proximate to said electron emitting element, for extracting electrons therefrom.

2. The microelectronic field emitter of claim 1 wherein said resistive bottom portion comprises gold-doped amorphous silicon.

3. The microelectronic field emitter of claim 2 wherein said conductive top portion comprises titanium.

4. The microelectronic field emitter of claim 1 wherein said at least one electrode on said insulating layer further extends beyond said insulating layer, to overhang said insulating layer adjacent said electron emitting element.

5. The microelectronic field emitter of claim 1 wherein said electron emitting element comprises a conical, pyramidal or linear pointed tip.

6. The microelectronic field emitter of claim 1 wherein said electron emitting element comprises a layer of low work function material on said conductive top portion.

7. The microelectronic field emitter of claim 1 wherein said electron emitting element comprises a cap of low work function material, for emitting electrons from an edge thereof.

8. The microelectronic field emitter of claim 1 further comprising an envelope over said electron emitting element, and spaced therefrom, for encapsulating said emitter.

9. The microelectronic field emitter of claim 8 wherein said envelope includes at least one electrical connection to said at least one electrode.

10. The microelectronic field emitter of claim 8 wherein said envelope includes at least one insulating layer and at least one conductive layer therein.

11. The microelectronic field emitter of claim 1 wherein said field emitter further comprises an address line at the base of said column, adjacent said bottom resistive portion.

12. The microelectronic field emitter of claim 1 wherein said at least one electrode comprises first and second conductive portions which are electrically insulated from one another.

13. A microelectronic field emitter array comprising:

a substrate;

an array of elongated vertical pillars on said substrate, orthogonally extending therefrom, each pillar having a wall, a conductive top portion opposite said substrate and a resistive bottom portion adjacent said substrate;

an electron emitting element on said each top portion;

an insulating layer on said substrate, between said vertical pillars, extending adjacent said walls;

a coating on said walls, between said insulating layer and said walls;

an extraction electrode on said insulating layer, extending parallel to said substrate, and proximate to said electron emitting element; and an emitter electrode adjacent said resistive bottom portion and electrically connected thereto, extending parallel to said substrate.

14. The microelectronic field emitter of claim 13 wherein said resistive bottom portion comprises gold-doped amorphous silicon.

15. The microelectronic field emitter of claim 14 wherein said conductive top portion comprises titanium.

16. The microelectronic field emitter of claim 13 wherein said extraction electrode on said insulating layer further extends beyond said insulating layer to overhang said insulating layer, adjacent said electron emitting element.

17. The microelectronic field emitter of claim 13 wherein said electron emitting element comprises a conical, pyramidal or linear pointed tip.

18. The microelectronic field emitter of claim 13 wherein said electron emitting element comprises a layer of low work function material on said conductive top portion.

19. The microelectronic field emitter of claim 13 wherein said electron emitting element comprises a cap of low work function material, for emitting electrons from an edge thereof.

20. The microelectronic field emitter of claim 13 further comprising an envelope over said field emitter array, and spaced therefrom, for encapsulating said field emitting array.

21. The microelectronic field emitter of claim 20 wherein said cover further comprises a plurality of partitions therein, for forming a plurality of encapsulation chambers.

22. A display device comprising:

a substrate;

an array of field emitters on said substrate, for emitting electrons therefrom in electron emission paths;

a display screen parallel to said substrate and in the electron emission paths; and at least one standoff between said substrate and said display screen, for maintaining said emitters and said display screen in spaced apart relation, said at least one standoff comprising a plurality of first spaced apart walls, and a plurality of second spaced apart walls which intersect said plurality of first spaced apart walls, said first and second spaced apart walls extending parallel to said electron emission paths, to surround the electron emission paths; and at least one spacer between said at least one standoff and one of said substrate and said display screen, for maintaining said at least one standoff in spaced apart relation between said one of said substrate and said display screen.

23. The display device of claim 22 wherein said at least one standoff comprises a first standoff which is mounted adjacent one of said substrate and said display screen.

24. The display device of claim 23 wherein said at least one standoff further comprises a second standoff mounted adjacent the other of said substrate and said display screen, wherein said second standoff comprises a plurality of third spaced apart walls, and a plurality of fourth spaced apart walls which intersect said plurality of third spaced apart walls, said third and fourth spaced apart walls extending parallel to said electron emission paths to surround the electron emission paths.

* * * * *

UNITED STATES PATENT AND TRADEMARK OFFICE

CERTIFICATE OF CORRECTION

PATENT NO. : 5,371,431

DATED : December 6, 1994

INVENTOR(S) : Jones et al.

It is certified that error appears in the above-identified patent and that said Letters Patent is hereby corrected as shown below:

Column 11, line 41, "filler layer 72" should be --filler layer 71--.

Signed and Sealed this

First Day of October, 1996

Bruce Lehman

*Attest:*

BRUCE LEHMAN

*Attesting Officer*

*Commissioner of Patents and Trademarks*